US010106294B2

(12) United States Patent
Böttcher

(10) Patent No.: US 10,106,294 B2
(45) Date of Patent: Oct. 23, 2018

(54) TRANSPORT RACK AND/OR STORAGE RACK, AND ARRANGEMENT OF A TRANSPORT RACK AND/OR STORAGE RACK ON A FLOOR PLATE

(71) Applicant: Carsten Böttcher, Rietberg (DE)

(72) Inventor: Carsten Böttcher, Rietberg (DE)

( * ) Notice: Subject to any disclaimer, the term of this patent is extended or adjusted under 35 U.S.C. 154(b) by 0 days.

(21) Appl. No.: 15/503,873

(22) PCT Filed: May 6, 2015

(86) PCT No.: PCT/EP2015/059935
§ 371 (c)(1),
(2) Date: Feb. 14, 2017

(87) PCT Pub. No.: WO2016/023649
PCT Pub. Date: Feb. 18, 2016

(65) Prior Publication Data

US 2017/0275051 A1 Sep. 28, 2017

(30) Foreign Application Priority Data

Aug. 15, 2014 (DE) ..... 20 2014 103 799 U

(51) Int. Cl.
*D06F 57/08* (2006.01)
*B65D 19/44* (2006.01)
(Continued)

(52) U.S. Cl.
CPC ..... *B65D 19/44* (2013.01); *A47B 47/0075* (2013.01); *A47B 81/00* (2013.01);
(Continued)

(58) Field of Classification Search
CPC ..... B65D 19/44; B65D 85/48; B65D 2519/00273; B65D 2519/00293;
(Continued)

(56) References Cited

U.S. PATENT DOCUMENTS 163,329 A * 5/1875 Reed ..... E04G 1/32
182/182.5
168,751 A * 10/1875 Kidder ..... D06F 57/08
211/198
(Continued)

FOREIGN PATENT DOCUMENTS

AU 4504772 1/1974
DE 2236934 2/1973
(Continued)

OTHER PUBLICATIONS

German Search Report dated Aug. 5, 2015 in related DE Application No. 20 2014 103 799.3.
(Continued)

*Primary Examiner* — Jonathan Liu
*Assistant Examiner* — Devin K Barnett
(74) *Attorney, Agent, or Firm* — Patent Portfolio Builders PLLC

(57) ABSTRACT

A transport rack and/or storage rack for standing transport and/or standing storage of plate-shaped goods, such as windows or doors, includes at least two support elements. A standing strip is arranged on a first end of each of the support elements and is removably fastenable, resting on a floor plate. The support elements are connected to each other by at least one crossbar placed on the support elements and the standing strip is aligned perpendicularly to the crossbar. The support elements are single or multi-part plates, having two leaning edges approaching each other at an acute angle away from a base side arranged on the standing strip.

10 Claims, 25 Drawing Sheets

(51) Int. Cl.
*B65D 85/48* (2006.01)
*A47B 47/00* (2006.01)
*A47B 81/00* (2006.01)

(52) U.S. Cl.
CPC .... *B65D 85/48* (2013.01); *B65D 2519/00273* (2013.01); *B65D 2519/00293* (2013.01); *B65D 2519/00323* (2013.01); *B65D 2519/00333* (2013.01); *B65D 2519/00815* (2013.01); *B65D 2571/00111* (2013.01); *D06F 57/08* (2013.01)

(58) Field of Classification Search
CPC ..... B65D 2519/00323; B65D 2519/00333; B65D 2519/00815; B65D 2571/00111; A47B 47/0075; A47B 81/00; D06F 57/08; Y10T 24/3412; Y10T 24/4091; Y10T 24/406; Y10T 24/4093; Y10T 403/54
USPC ..... 211/85.8, 198, 41.1, 41.14, 41.15; 108/51.11, 55.3, 55.5, 57.2; 206/448, 206/449, 451, 454, 597
See application file for complete search history.

(56) References Cited

U.S. PATENT DOCUMENTS 223,667 A * 1/1880 Church ..... A47F 7/0028 211/60.1
429,023 A * 5/1890 Fletcher ..... D06F 57/08 211/198
862,104 A * 7/1907 Rauschenbusch ..... D06F 57/08 211/198
1,628,936 A * 5/1927 Turner ..... D06F 57/08 211/119.011
2,002,128 A * 5/1935 Reidenbaugh ..... A47F 5/01 108/107
2,116,381 A * 5/1938 Burke ..... B65D 19/44 206/597
2,235,012 A * 3/1941 Colvin ..... B60R 9/12 211/70.5
2,760,647 A * 8/1956 Saul ..... A47B 57/30 211/182
2,839,198 A * 6/1958 Lefevre ..... B65D 85/48 108/55.1
2,965,159 A * 12/1960 Fridolph ..... A47B 3/10 211/198
3,147,860 A * 9/1964 Kean, Sr. ..... B65D 19/08 108/53.5
3,173,645 A * 3/1965 Gray ..... B61D 45/00 410/99
3,878,942 A * 4/1975 Hansen ..... B65D 85/48 206/454
3,955,676 A * 5/1976 Hansen ..... B65D 85/48 206/451
3,955,731 A * 5/1976 Lindelef ..... B60P 3/38 224/328
4,278,171 A * 7/1981 Millhoan ..... B65G 49/062 206/451
4,304,336 A * 12/1981 Mays ..... B60P 3/002 211/41.14
4,643,610 A * 2/1987 Bien ..... F16B 37/043 403/326
4,880,116 A * 11/1989 Kos ..... H01L 21/67369 206/454
4,924,557 A * 5/1990 Heckerman ..... A44B 11/006 224/908
5,085,329 A * 2/1992 Crowell ..... B65D 85/48 211/195
5,133,461 A * 7/1992 Martinell ..... B62H 3/04 211/198
5,193,692 A * 3/1993 Farley ..... B65D 81/107 211/40
5,209,539 A * 5/1993 Atalay ..... A63B 55/10 211/198
5,226,764 A * 7/1993 Meriwether ..... B60P 7/0869 206/453
5,240,123 A * 8/1993 Hawk ..... A47F 7/06 211/30
5,269,422 A * 12/1993 Chevrette ..... B65D 5/5042 206/448
5,284,256 A * 2/1994 Correll-Antoun ..... A47B 63/00 211/198
5,349,770 A * 9/1994 Bursey ..... G09F 1/12 206/449
5,398,832 A * 3/1995 Clive-Smith ..... B60P 7/0815 108/55.3
5,411,360 A * 5/1995 Hilliker ..... B60P 1/02 108/53.5
5,515,977 A * 5/1996 Lambert ..... B65D 19/44 206/395
5,685,437 A * 11/1997 Lisec ..... B65G 49/062 211/41.14
5,755,339 A * 5/1998 Belanger ..... B60P 3/002 211/41.14
5,769,598 A * 6/1998 MacNeil ..... B65D 19/38 206/459.1
5,873,468 A * 2/1999 Ejima ..... H01L 21/67376 206/454
5,906,282 A * 5/1999 Aldrich ..... B65G 49/062 206/454
5,915,570 A * 6/1999 Orsini ..... A47B 45/00 211/198
6,098,818 A * 8/2000 Ali ..... A47F 7/143 211/50
6,254,051 B1 * 7/2001 Hubbard ..... F24H 9/06 126/24
6,254,052 B1 * 7/2001 Hubbard ..... F24H 9/06 248/225.11
6,264,047 B1 * 7/2001 Crumley ..... A45C 13/03 190/102
6,311,371 B1 * 11/2001 Dazzo ..... B65D 19/0097 206/386
6,345,693 B1 * 2/2002 Yeo ..... B25H 1/0014 187/211
6,386,376 B1 * 5/2002 Mendoza-Castillo ..... B65G 49/062 206/454
6,478,281 B1 * 11/2002 Turner ..... A47B 97/04 108/50.17
6,536,607 B1 * 3/2003 Knoll ..... B65G 49/062 211/41.14
6,702,122 B2 * 3/2004 Hopkins ..... B25H 3/04 211/13.1
7,264,126 B1 * 9/2007 Bergeron ..... B65D 85/46 206/454
7,537,125 B2 * 5/2009 Plouchart ..... B25H 3/04 211/198
7,703,225 B2 * 4/2010 Kerker ..... G09F 1/10 211/128.1
7,766,170 B2 * 8/2010 Mansson ..... B65D 71/0096 206/597
8,376,291 B1 * 2/2013 Groves ..... B25H 1/06 182/153
8,479,928 B2 * 7/2013 Tanabe ..... A47B 43/00 211/64
8,777,008 B2 * 7/2014 Hu ..... B65D 25/103 206/454
8,783,473 B1 * 7/2014 Schosek ..... A47G 25/0664 211/198
8,789,710 B1 * 7/2014 Moore ..... B62B 1/20 211/41.14
2003/0164343 A1 * 9/2003 Kaufmann ..... F16M 11/041 211/13.1
2003/0173314 A1 * 9/2003 Knoll ..... B65G 49/062 211/41.14
2003/0196971 A1 * 10/2003 Jeskey ..... B65G 49/062 211/41.14
2004/0016373 A1 * 1/2004 Bodde ..... B65D 19/44 108/55.5

(56) References Cited

U.S. PATENT DOCUMENTS

2004/0238465 A1* 12/2004 Mercure ..... A47B 81/00 211/41.14
2005/0238455 A1* 10/2005 Toteff ..... B60P 3/077 410/104
2006/0058718 A1* 3/2006 Moeller ..... A61F 5/055 602/18
2006/0108249 A1* 5/2006 Riddleburgh ..... B65D 81/053 206/453
2006/0226046 A1* 10/2006 Matsumoto ..... B65D 19/38 206/597
2006/0236901 A1* 10/2006 Lin ..... B65D 19/0026 108/55.3
2007/0246613 A1* 10/2007 Kennedy ..... H02G 3/32 248/56
2008/0210649 A1* 9/2008 Faust ..... A47F 5/0807 211/59.1
2009/0114408 A1* 5/2009 Roberts ..... E02D 3/02 172/611
2009/0205999 A1* 8/2009 Smith ..... B65D 19/40 206/597
2014/0246347 A1* 9/2014 Burkardt ..... B65D 19/02 206/386
2014/0251190 A1* 9/2014 Kessler ..... B65D 19/38 108/57.25
2014/0291187 A1* 10/2014 Servaes ..... A47F 7/0042 206/454
2015/0136716 A1* 5/2015 Piccininno ..... B65G 49/062 211/41.14
2015/0368029 A1* 12/2015 Kronsteiner ..... B62B 3/108 211/85.8
2016/0152171 A1* 6/2016 Boyer ..... B60P 7/0892 410/97
2018/0146780 A1* 5/2018 Matuszewski ..... A47B 96/14
2018/0187703 A1* 7/2018 Kuperus ..... F16B 1/02

FOREIGN PATENT DOCUMENTS

DE 29722858 U1 4/1998
DE 10010325 A1 9/2001
DE 202006016590 U1 12/2006
DE 202009007881 U1 10/2009
DE 102011053460 A1 3/2012
ES 2403542 A1 5/2013
JP S5584285 U 6/1980
JP H07137742 A 5/1995

OTHER PUBLICATIONS

International Search Report dated Sep. 9, 2015 in related International Application No. PCT/EP2015/059935.
Written Opinion dated Sep. 9, 2015 in related International Application No. PCT/EP2015/059935.

* cited by examiner 53
52
51
$b_1$
$b_2$
5

TRANSPORT RACK AND/OR STORAGE RACK, AND ARRANGEMENT OF A TRANSPORT RACK AND/OR STORAGE RACK ON A FLOOR PLATE

BACKGROUND AND SUMMARY OF THE INVENTION

Exemplary embodiments of the invention are directed to a transport rack and/or storage rack, and arrangement of a transport rack and/or storage rack on a base plate.

The present invention relates to a transport rack and/or storage rack for standing transport or standing storage of plate-shaped goods, especially windows, doors, glass panes or stone slabs, as well as an arrangement of a transport rack and/or storage rack on a base plate.

Generic transport racks and/or storage racks are known for example from German patent documents DE 10 2011 053 460 A1 and DE 100 10 325 A1.

The transport rack and/or storage rack disclosed in DE 10 2011 053 460 A1 substantially consists of two a-shaped frame parts with upright bars arranged at an acute angle with respect to each other, on which the plate-shaped elements such as glass panels can be leaned. Base strips are fixed to the upright bars formed as square tube profiles, on which fastening means are welded which engage around a transverse board of a Euro pallet.

DE 100 10 325 A1 discloses a transport frame, in which the frame parts are made of profiled steel and is formed as a folding apparatus, connected to each other by joints.

Both frames have a common disadvantage in that they require a large amount of storage place. In particular, these transport frames are further relatively expensive to purchase as a result of their material and their joints etc.

The frames according to DE 10 2011 053 460 A1 can only be fixed to specific pallets, especially Euro pallets, as a result of the fastening means welded onto the base strips, because they are placed in gaps between the cover boards of the pallet. Furthermore, the pallet must comprise transverse boards oriented perpendicularly to the cover boards and surrounded by the fastening means for fixing the frames.

The return transport of such transport frames is also relatively expensive as a result of their relatively high need for space and their large mass.

Exemplary embodiments of the present invention are directed to a transport rack and/or storage rack for the standing transport and/or standing storage of plate-shaped goods, as well as an arrangement of a transport rack and/or storage rack on a base plate, which can be produced at low cost and can be transported (back) at low cost.

According to one aspect of the invention, the transport rack and/or storage rack comprises at least two support elements. A standing strip is arranged on a first end of each of the support elements, which standing strip is removably fastenable to a base plate, in particular a pallet, while resting thereon.

The support elements are formed as single or multipart plates, having two leaning edges approaching each other at an acute angle away from a base side arranged on the standing strip. Furthermore, the support elements are connected to each other by at least one crossbar that is attachable to the support elements.

Such a transport rack and/or storage rack can be produced and designed in an exceptionally cost-effective manner because it can be assembled and disassembled with the simplest means.

The capability for simplified disassembly offers the further major advantage that a return transport of such a transport rack and/or storage rack after use can occur in an exceptionally compact way by taking the transport rack and/or storage rack apart.

The ability to attach the crossbar contributes to the simple mounting and dismounting of the transport rack and/or storage rack and also ensures an adequately stable connection between the support elements.

As a result of the cost-effective production, the transport rack and/or storage rack in accordance with the invention can generally be used as a so-called single-use frame, so that a return transport of the transport rack and/or storage rack is merely optional.

It can also be considered, as a result of the cost-effective production of the transport rack and/or storage rack in accordance with the invention, to use a so-called single-use pallet and to entirely forgo a return transport of the transport rack and/or storage rack.

This ensures that it is not necessary to exchange transport racks and/or storage racks or the base plates in the case of a delivery of plate-shaped goods with a transport rack and/or storage rack in accordance with the invention.

Especially in the case of customers that do not have any Euro pallets on stock for the exchange of goods, the use of the transport rack and/or storage rack in accordance with the invention, in conjunction with a single-use pallet, allows a simple and uncomplicated delivery of plate-shaped goods without having to exchange transport racks and/or storage racks and/or pallets, or having to deposit collateral for the transport racks and/or storage racks and/or pallets.

According to an aspect of the invention, the first end of the support elements comprises a protrusion formed in the manner of a trapeze and accommodated in a respectively shaped recess of the standing strip, extending away from a base side of the respective support element, said base side resting on the standing strip.

This leads to an exceptionally stable connection between the spanning strip and the support element.

According to an aspect of the invention, the transport rack and/or storage rack comprises at least two support elements. A standing strip is arranged at a first end of each of the support elements, which standing strip is removably fastenable to a base plate, especially a pallet.

Each of the support elements comprises at least one recess, through which a fastening strap can be guided for fixing the plate-shaped goods, wherein the recess comprises two grooves extending away from an opening, whose inner boundary is delimited by a tongue extending in the longitudinal direction of the support element from an edge of the recess to the opening, wherein a loop of the fastening strap, with which the plate-shaped article can be fixed to the support element and the base plate, can be guided through the grooves while engaging behind the tongue.

A recess formed in this manner allows an exceptionally stable fixing of the plate-shaped item to be transported on the support element and the base plate. By fixing the item with a fastening strap, the connection between the standing strip, the support element and the base plate is additionally reinforced.

According to one aspect of the invention, at least one crossbar comprises several slots arranged on a longitudinal edge, which allows a variable distance of the support element from each other.

In a preferred embodiment, the slots are arranged in pairs adjacent to each other, wherein the width of a first slot of a pair of slots is greater than the width of a second slot of a pair of slots, wherein the first slot is formed as a receiving slot for accommodating an upper edge or a leaning edge of the support element and the second slot as an expansion slot.

This promotes the mounting of the crossbar on the support element. Furthermore, the expansion slots allow a compensation of production tolerances concerning the material thickness of the support elements.

For the purpose of retaining the support elements on the standing strip, the first end of each support element is preferably retained in an interlocking manner on the standing strip at least along the base side of the support element.

According to a further preferred embodiment of the invention, the leaning edges of the support elements are equally long and are preferably formed under the same acute angle in relation to the longitudinal axis of the support elements. With such a transport rack and/or storage rack, the plate-shaped goods can be transported and/or stored in a leaning manner on both sides on the support elements.

According to an alternative embodiment, the first leaning edge of each support element is oriented perpendicularly to the base side of the plate, wherein the plate-shaped goods can be leaned on a second leaning edge. The second leaning edge extends at an acute angle from a base side arranged on the standing strip towards the first leaning edge. With such a transport rack and/or storage rack, the plate-shaped goods can be transported and/or stored in a leaning manner on one side on one of the leaning edges of the support elements.

According to a further embodiment of the invention, the support elements are formed as trapezoidal plates, having an upper edge parallel to the base side, on which the at least one crossbar is mounted.

The support elements, the at least one crossbar and the standing strip are made in an especially preferred way from wood, metal or a dimensionally stable base material, which ensures a simple and cost-effective production of the transport rack and/or storage rack.

According to a further preferred embodiment of the invention, each of the support elements comprises at least one recess, through which fastening straps can be guided for fixing the plate-shaped goods. The recess is preferably formed in a round manner, but polygonal (e.g. trapezoidal) recesses can also be considered.

According to a further preferred embodiment of the invention, stops are arranged at the ends of the support surface, which stops are spaced from each other in the longitudinal direction and which prevent slippage of the plate-shaped goods from the leaning edges.

According to a further embodiment of the invention, the width of the tongue close to the free end of the tongue is greater than the width of the tongue close to the root of the tongue. This prevents slippage of the fastening strap enclosing the tongue, especially during transport, in which numerous jolts and vibrations of the transport rack and/or storage rack occur as a result of bumpy roads.

The arrangement of a transport rack and/or storage rack in accordance with the invention on a base plate, especially a pallet, especially a single-use pallet, is characterized in that the standing strip, in a state where the transport rack and/or storage rack is fixed to a base plate, is fixed in a friction-locked manner to the base plate by means of a tensioning strap.

Such a tensioning strap provides a simple and cost-effective fixing of the support elements fixed to the standing strip.

The tensioning strap is preferably formed as a tensioning belt, steel belt or plastic band.

BRIEF DESCRIPTION OF THE DRAWING FIGURES

Embodiments of the invention are explained below in closer detail by reference to the enclosed drawings wherein.

Figure 5C:
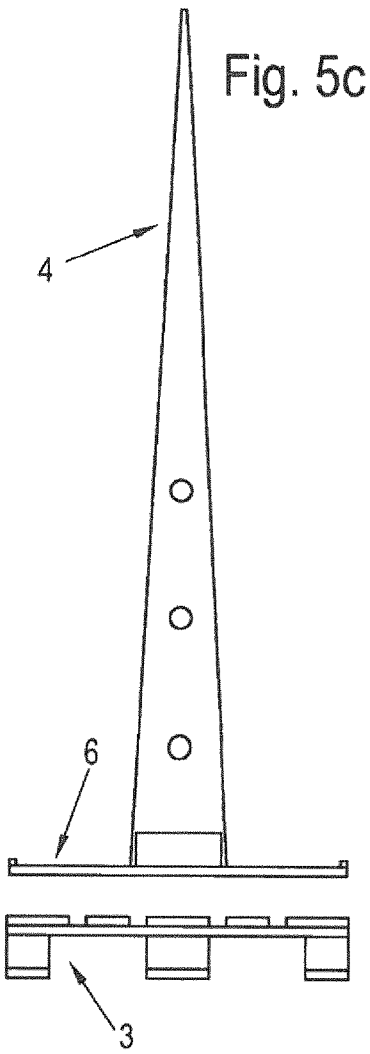
Figure 5B:
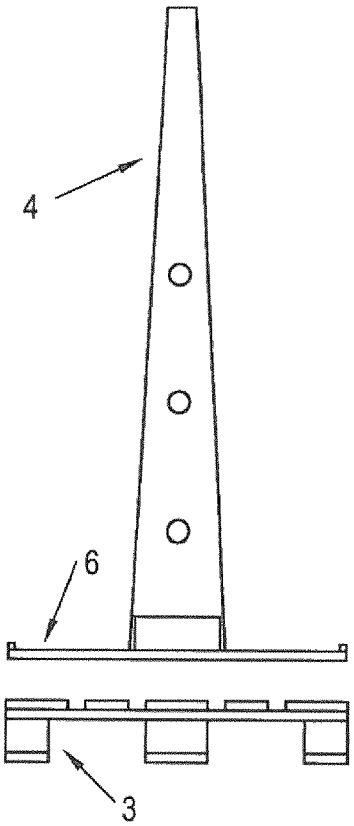
Figure 5A:
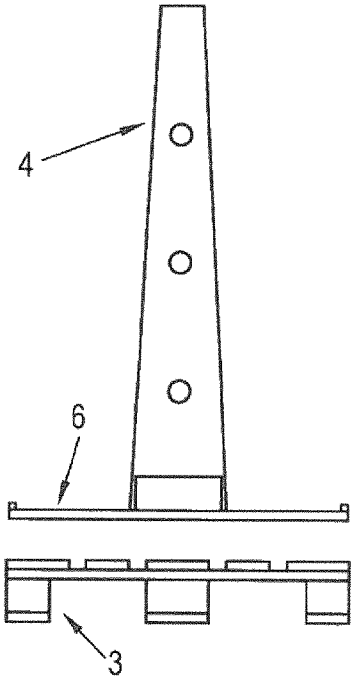
Figure 6C:
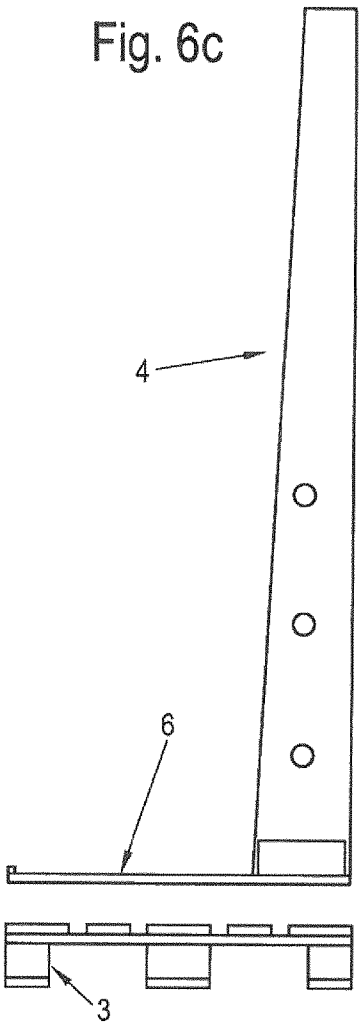
Figure 6B:
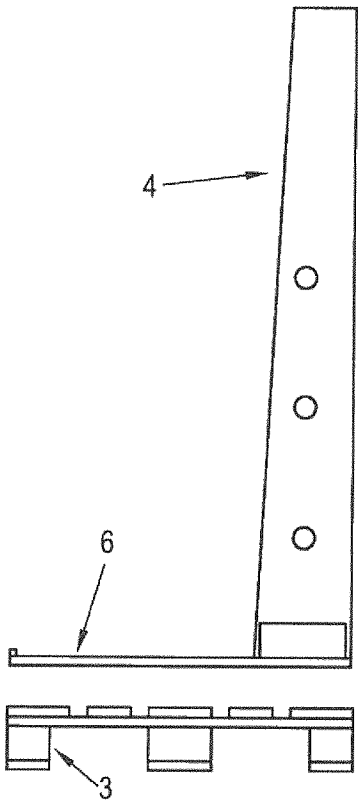
Figure 6A:
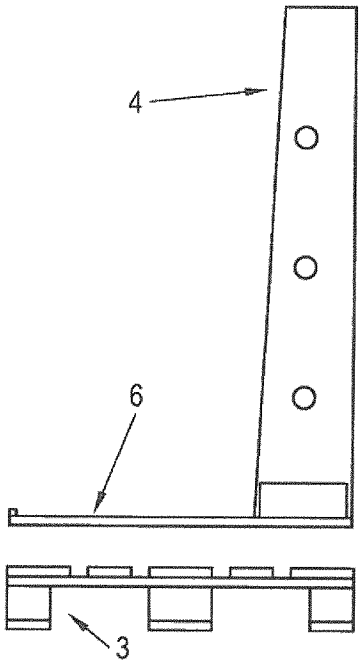
Figure 7:
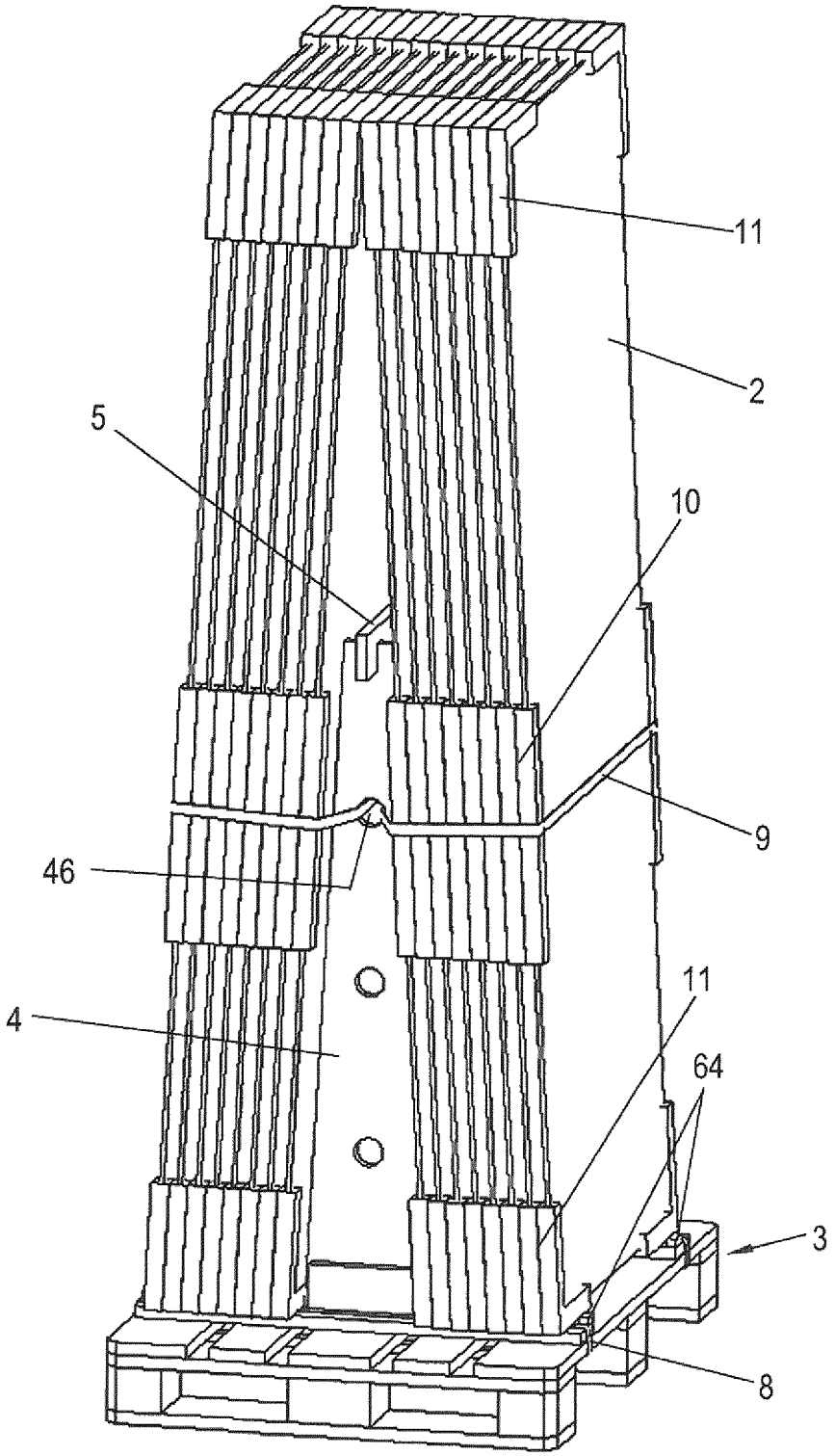
Figure 9:
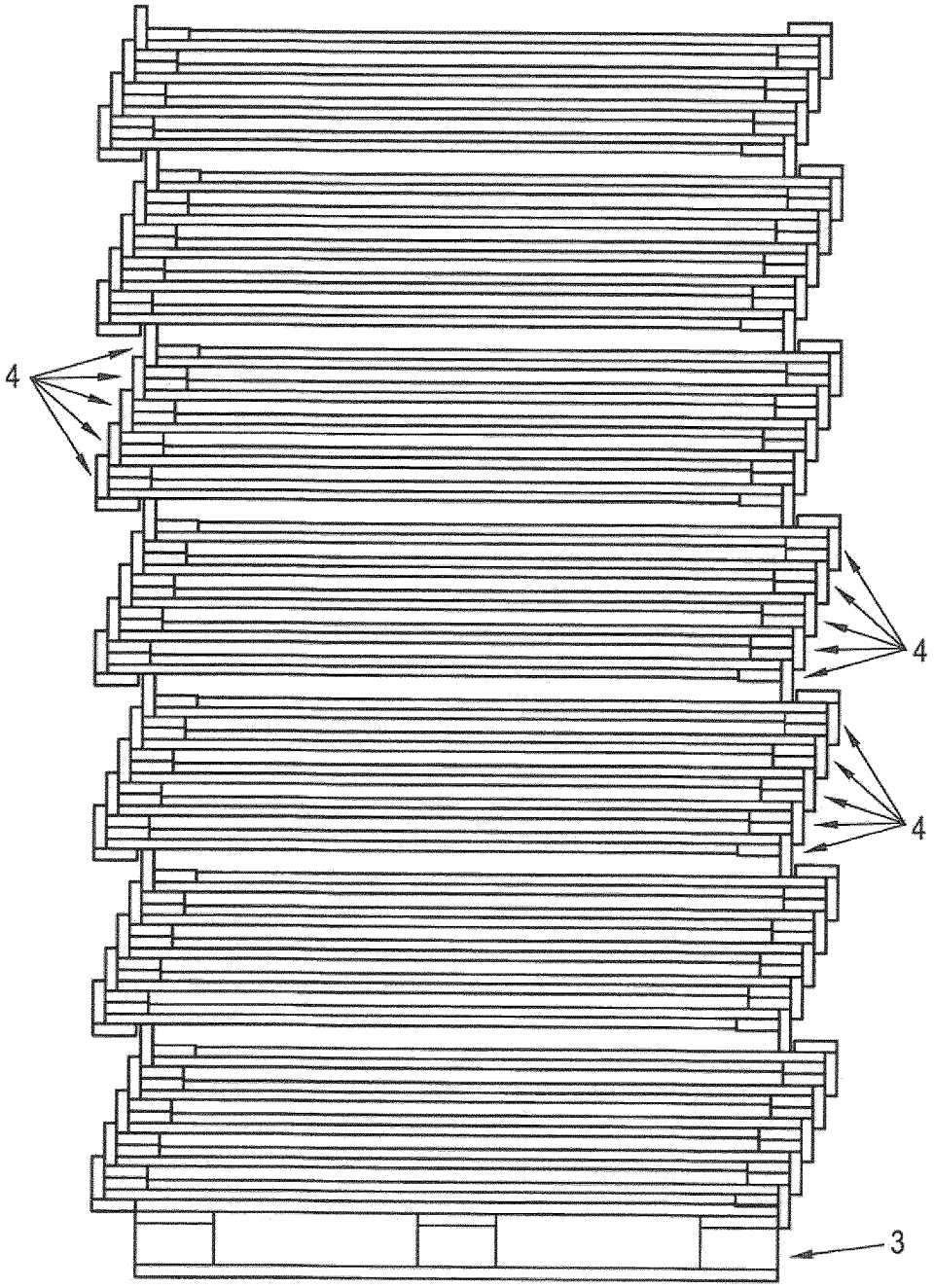
Figure 10:
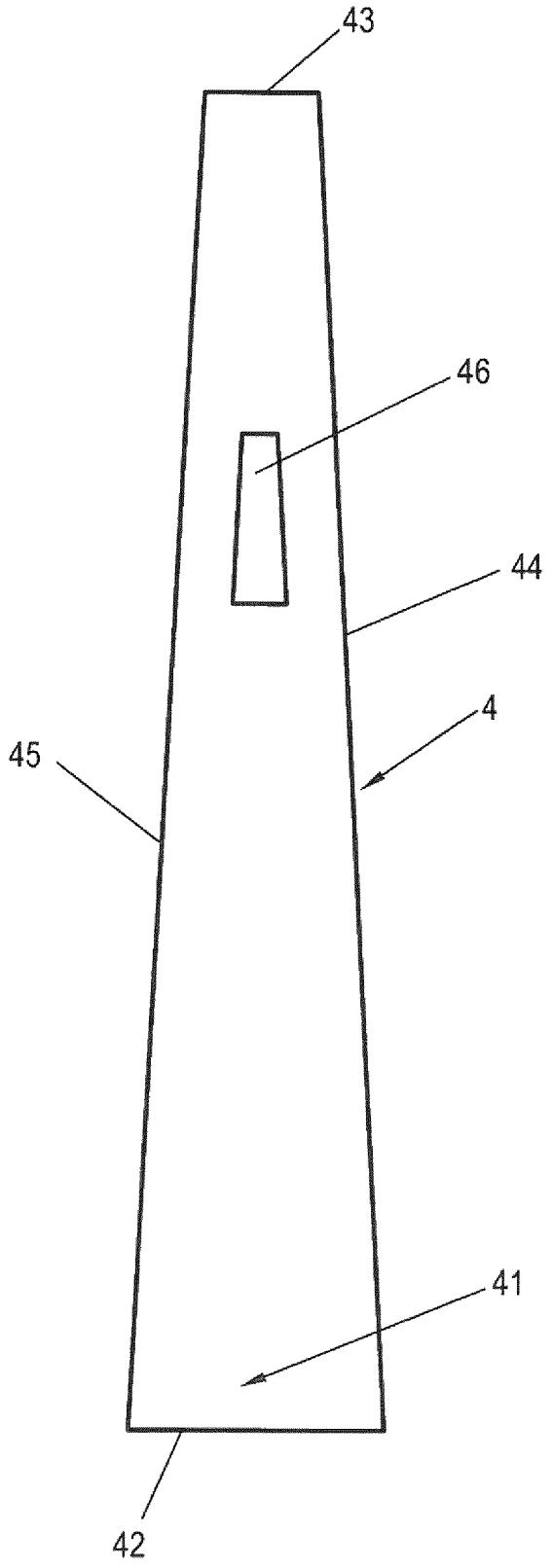
Figure 11B:
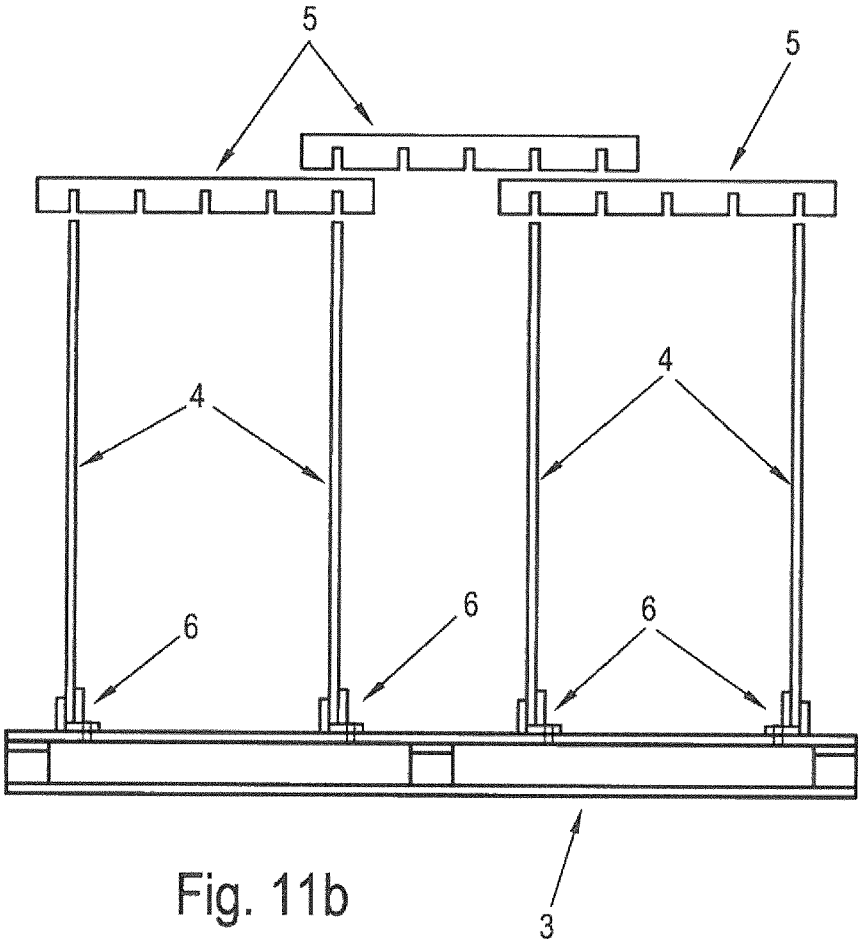
Figure 11A:
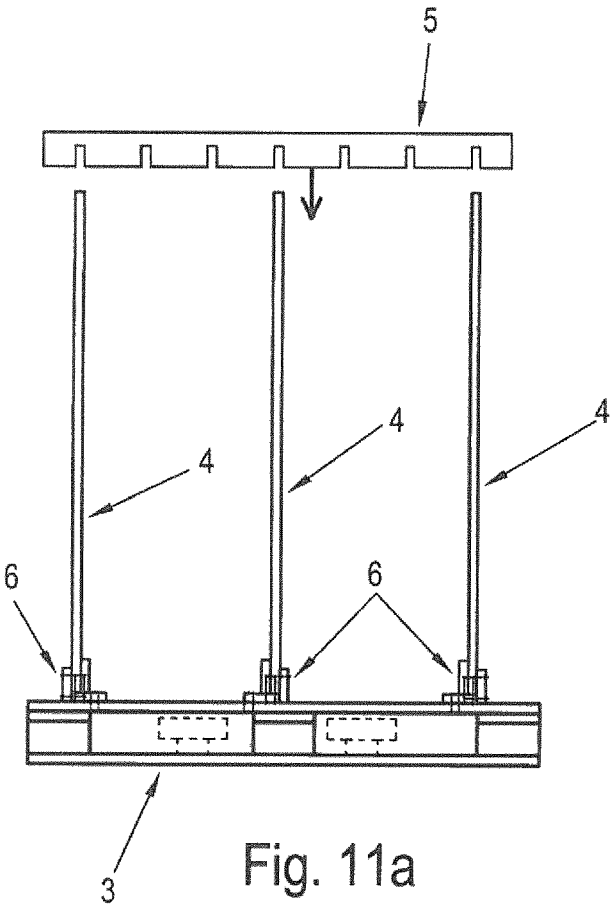
Figure 11D:
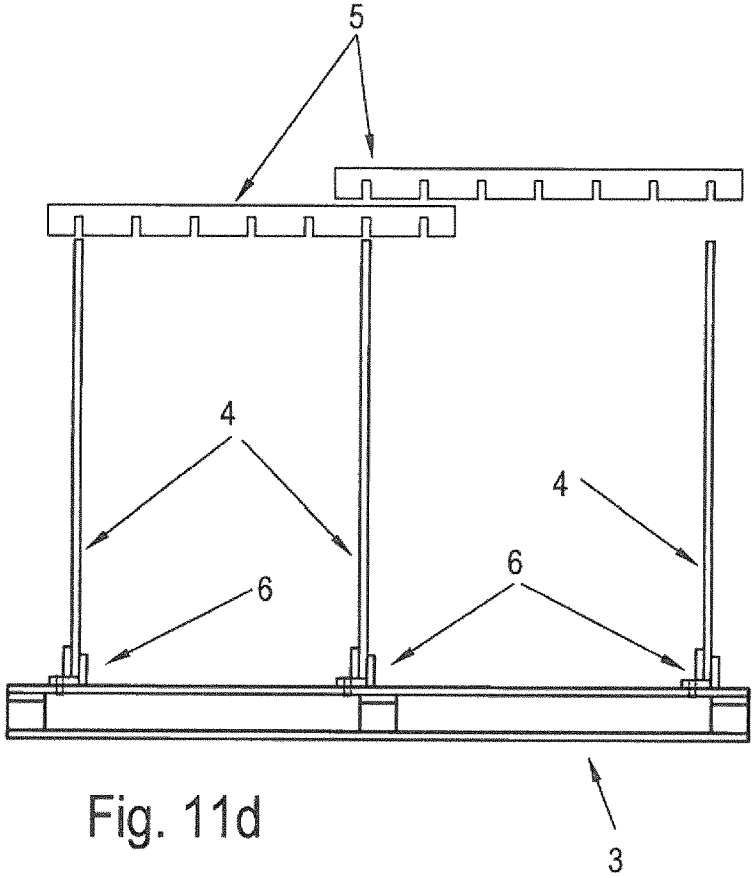
Figure 11C:
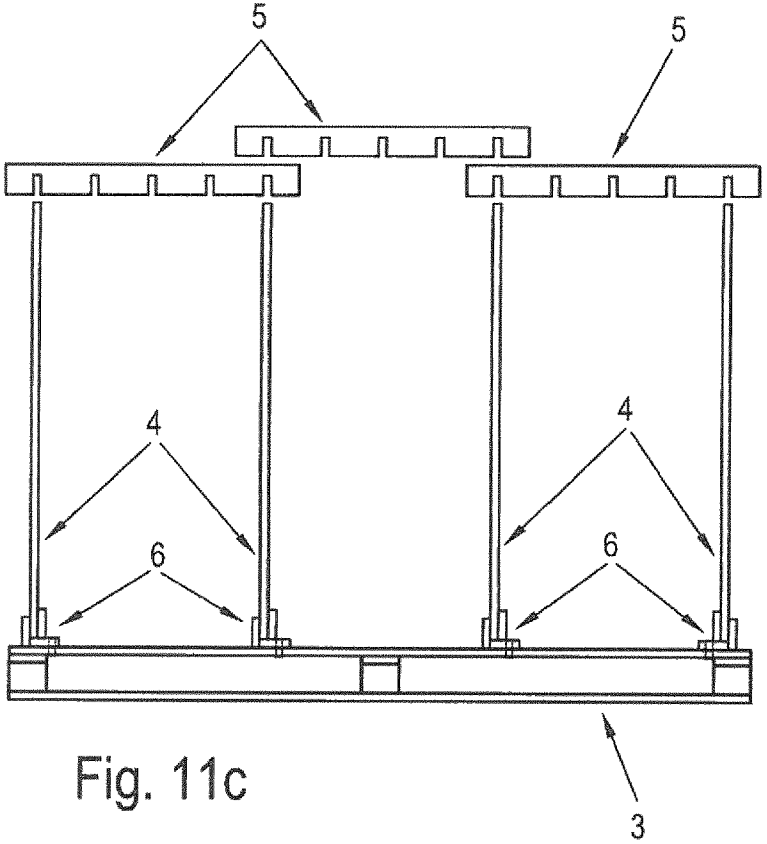
Figure 12:
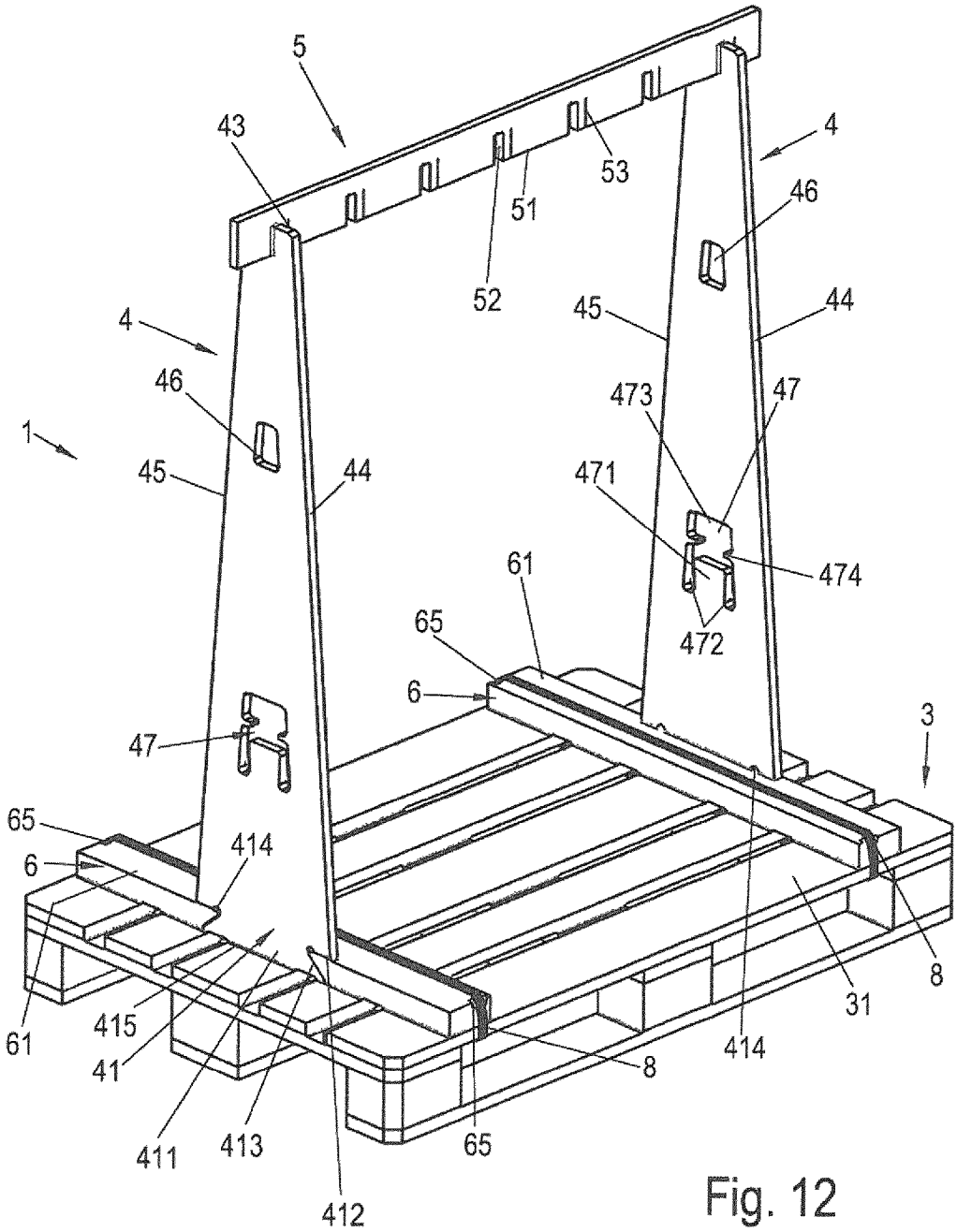
Figure 13:
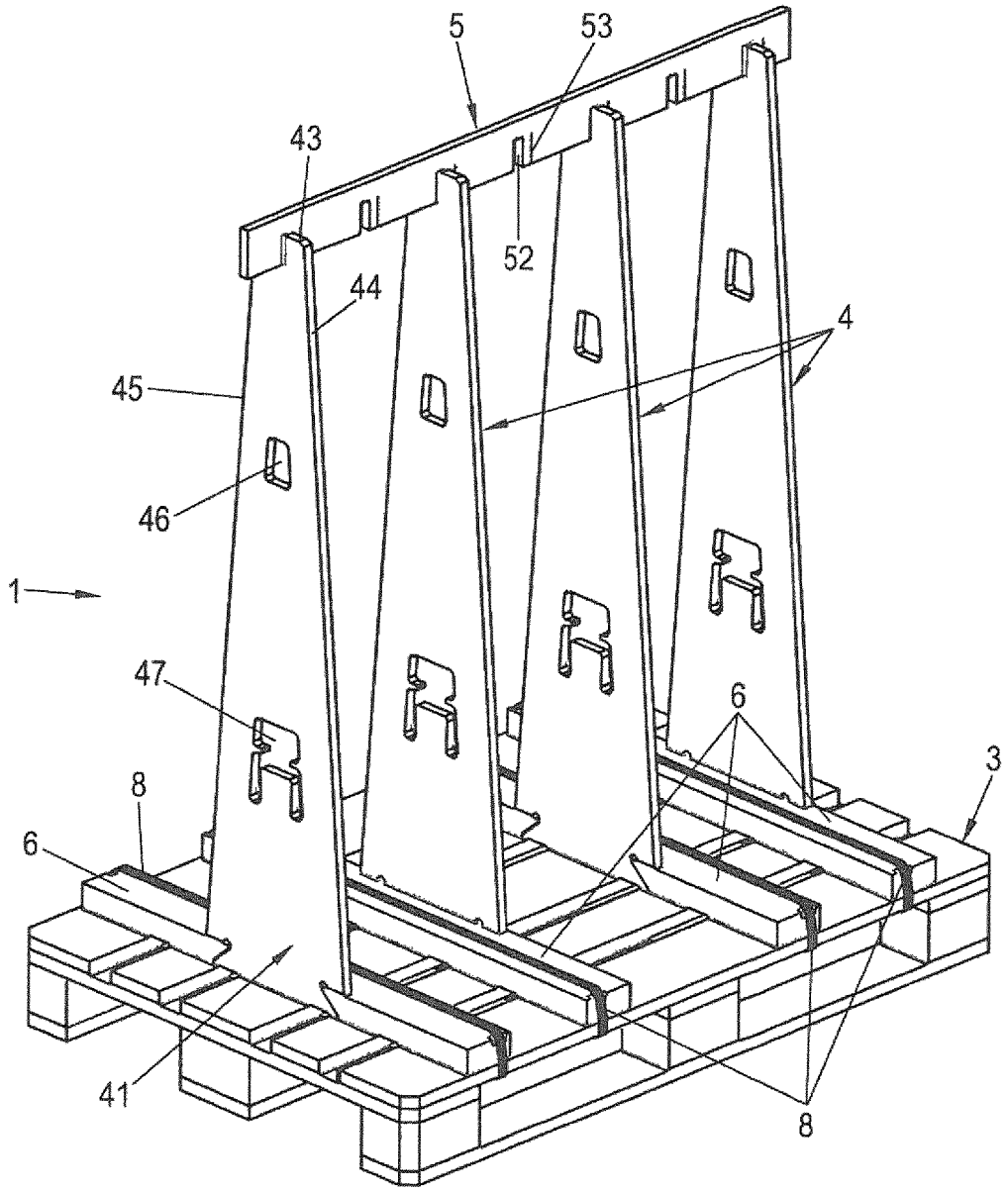
Figure 14:
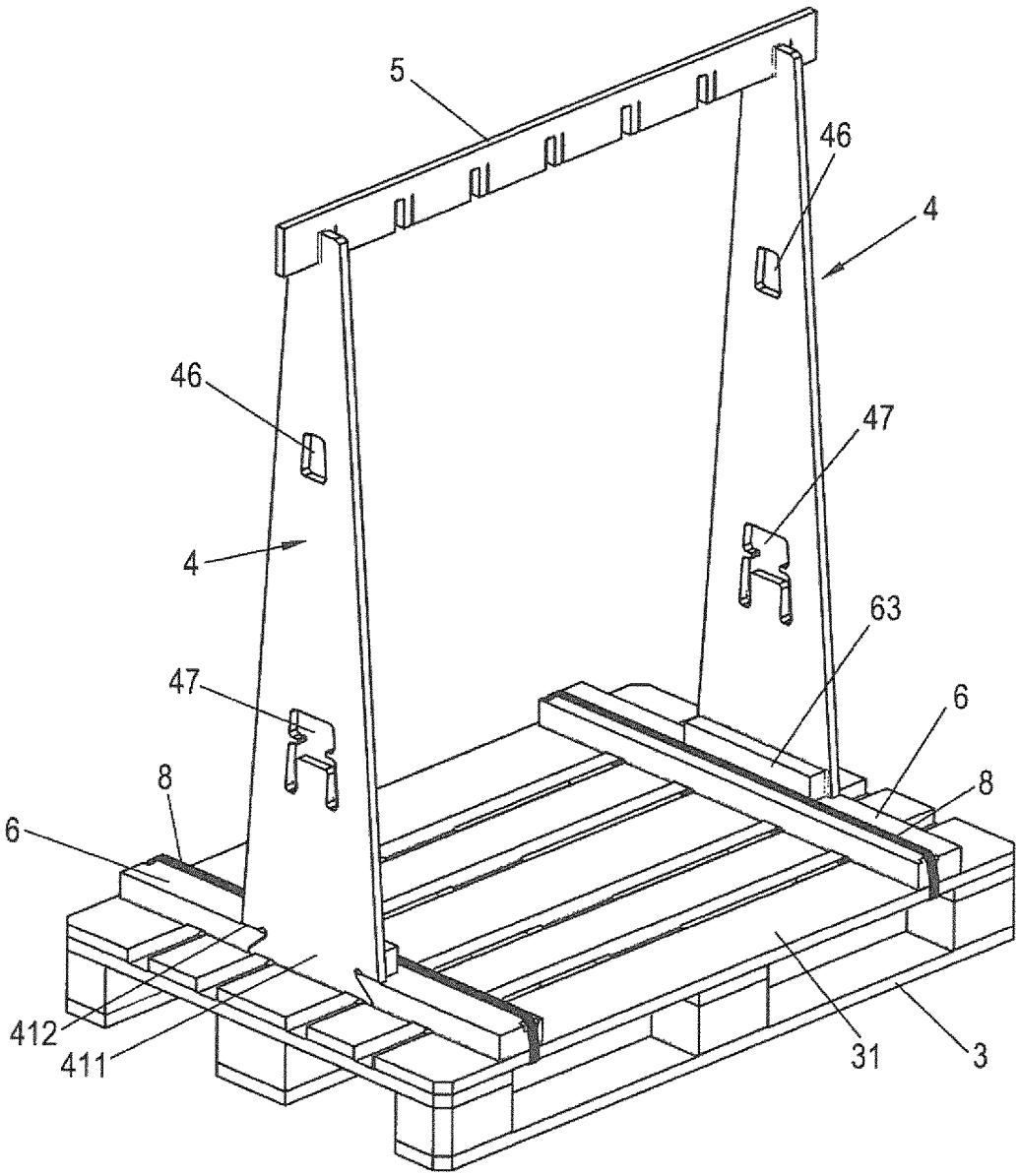
Figure 15:
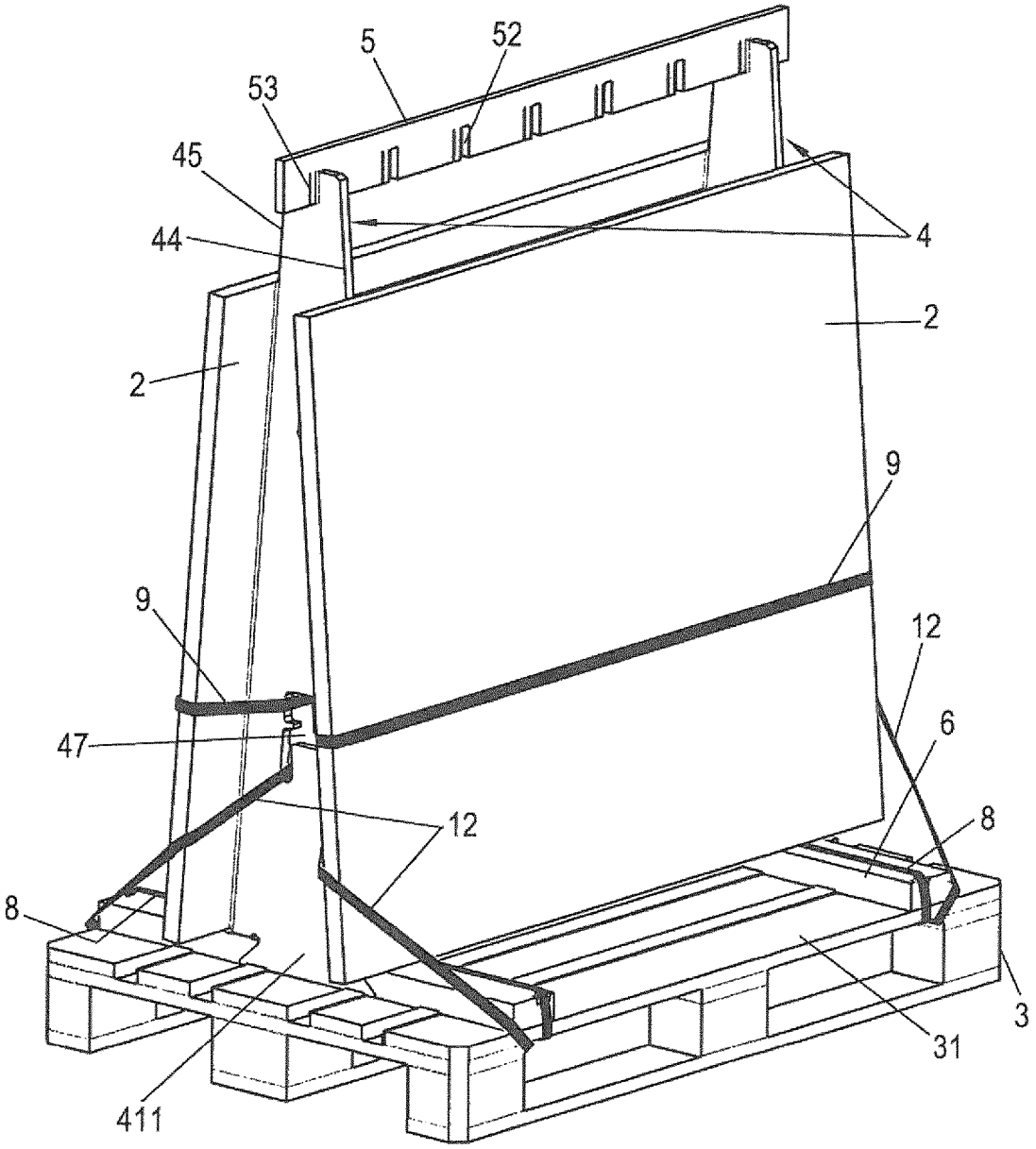
Figure 16:
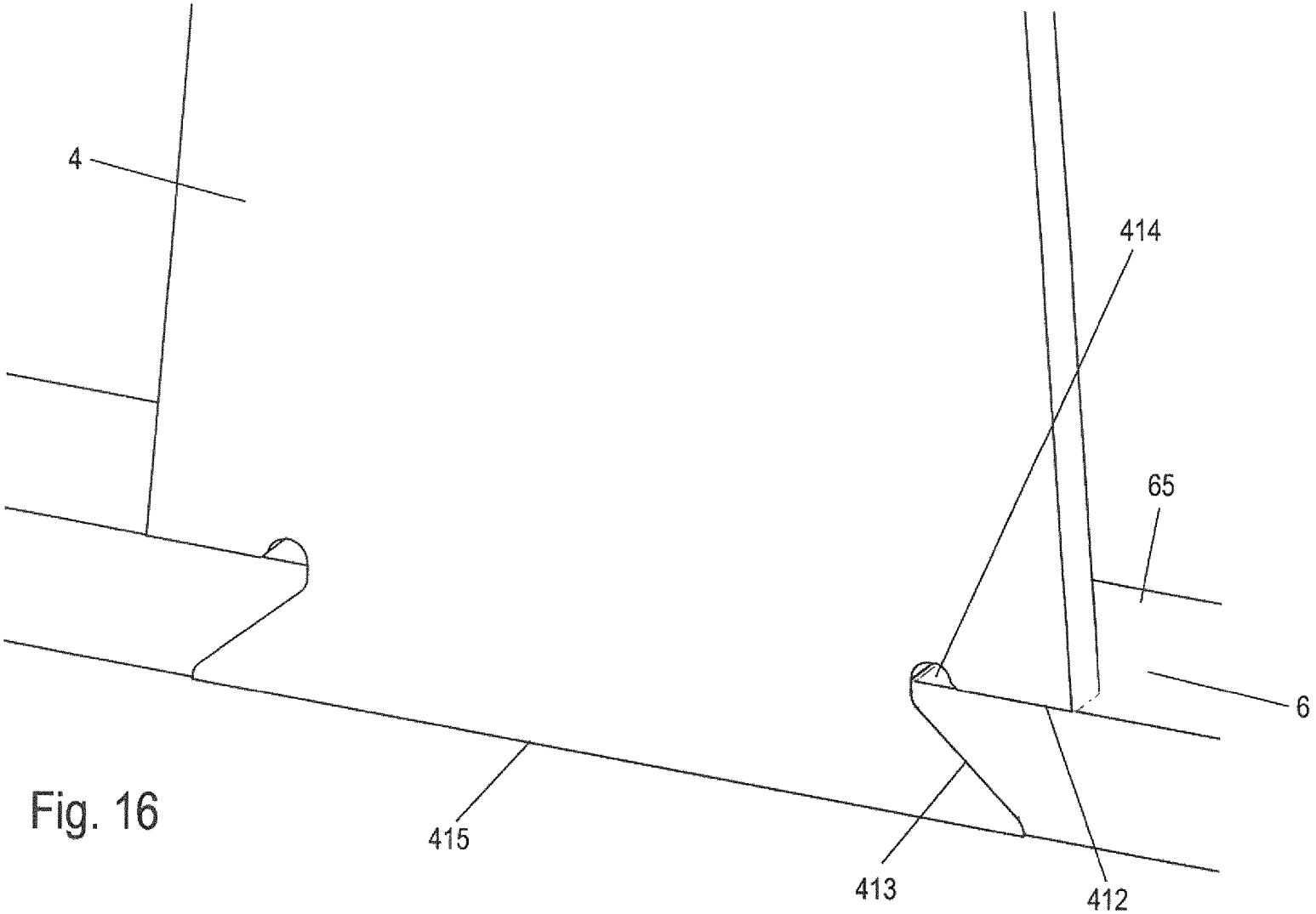
Figure 17:
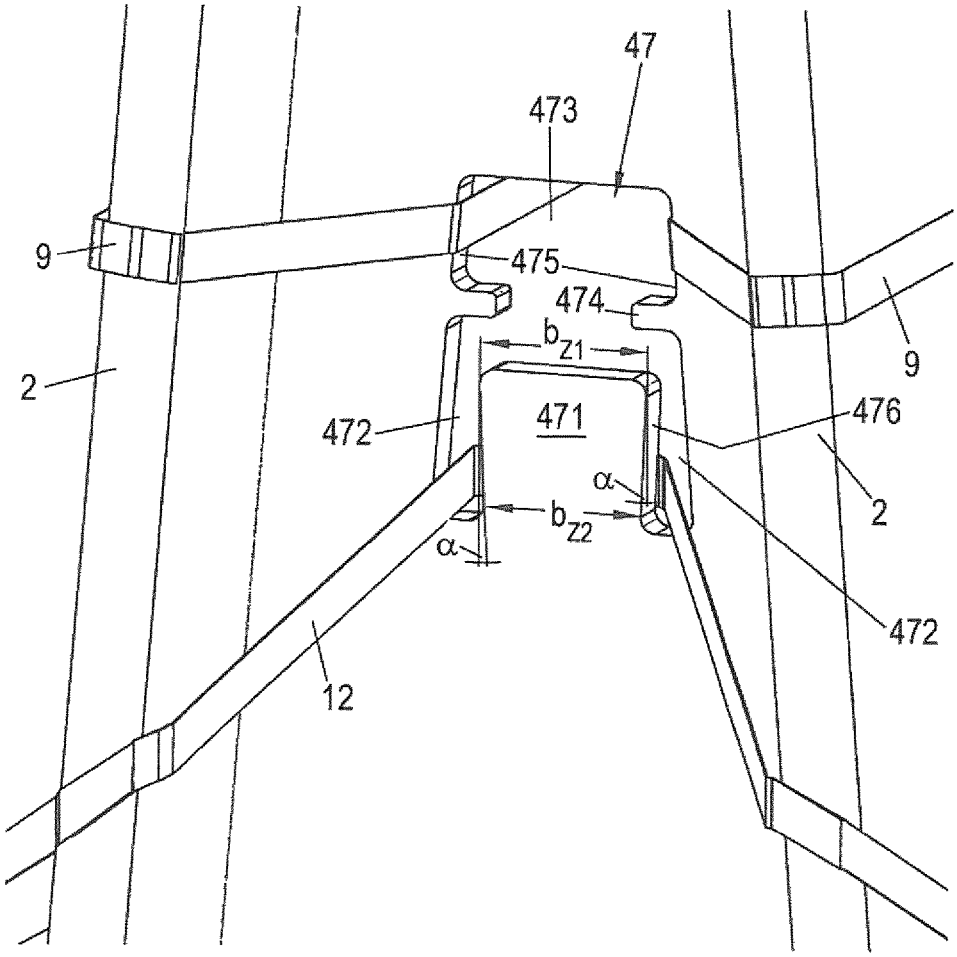
Figure 18:
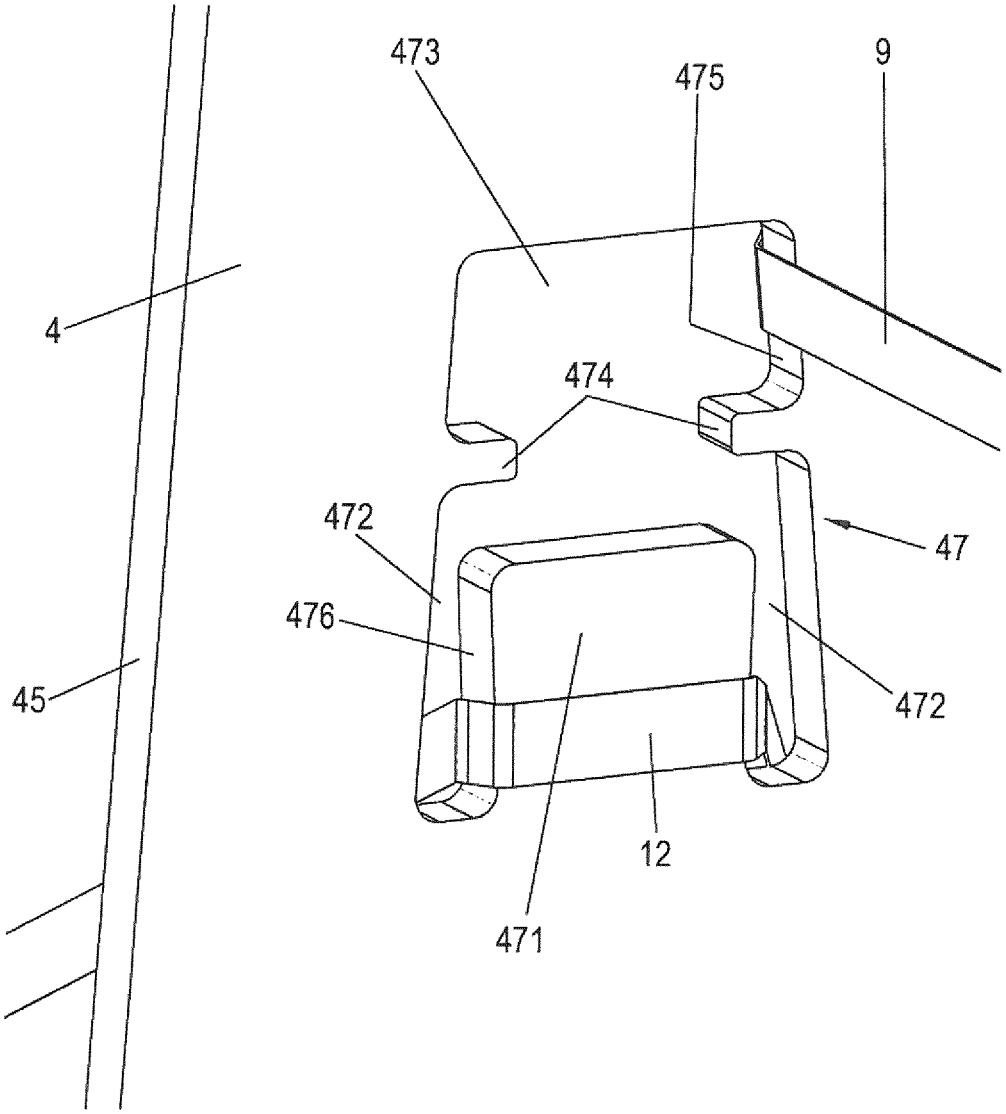
Figure 19:
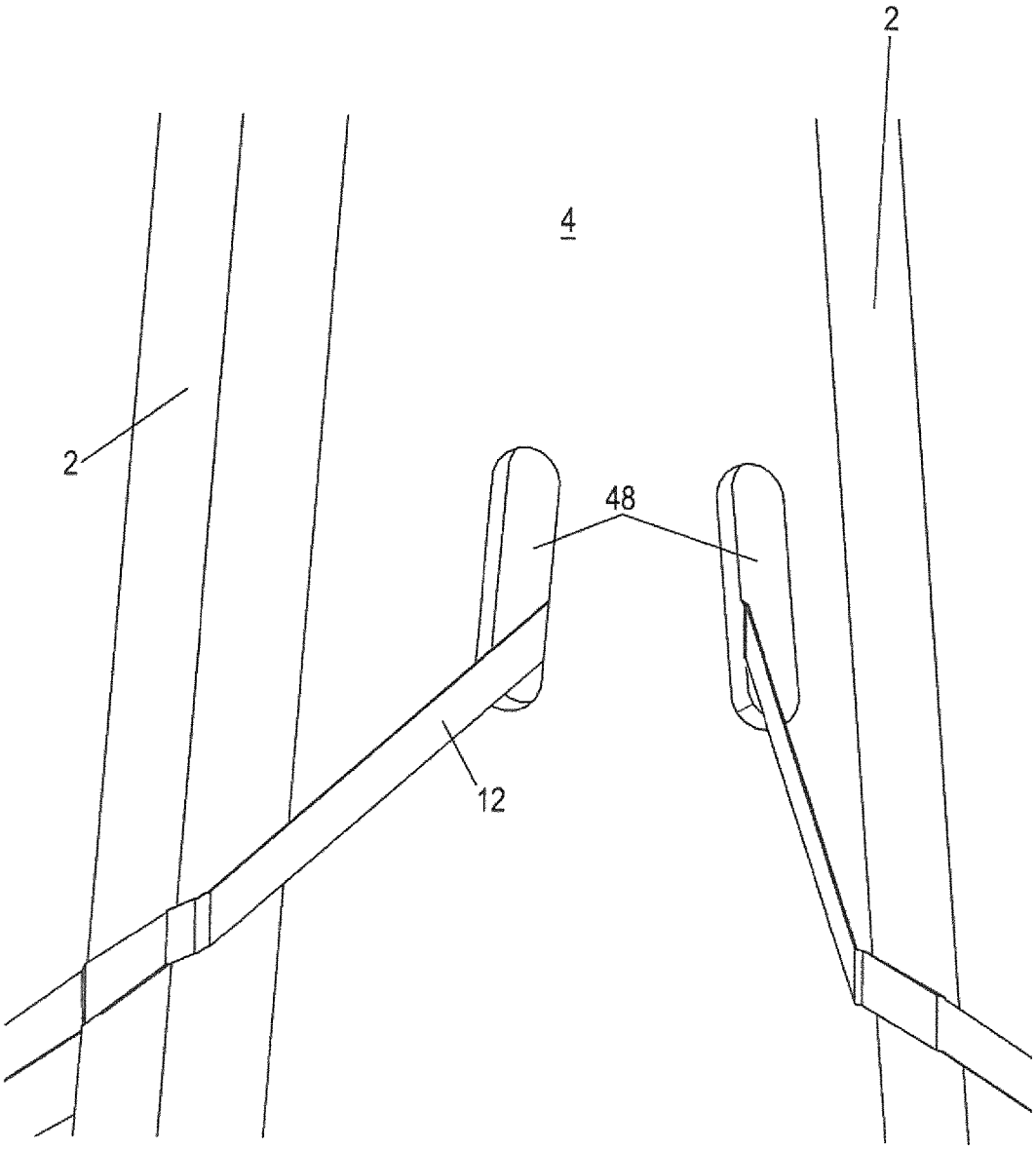
Figures 20A, 20B, 20C, 20D, 20E, 20F:
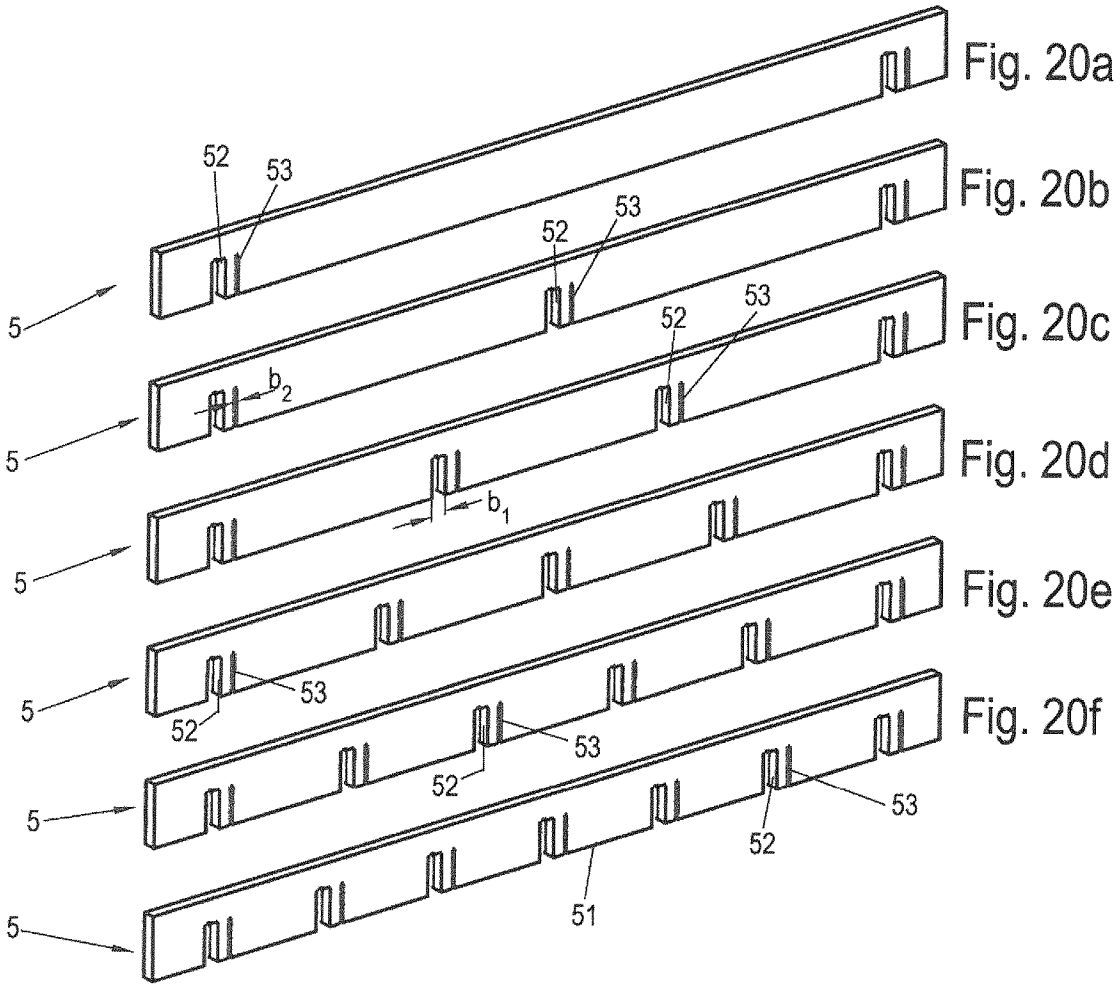
Figure 21:
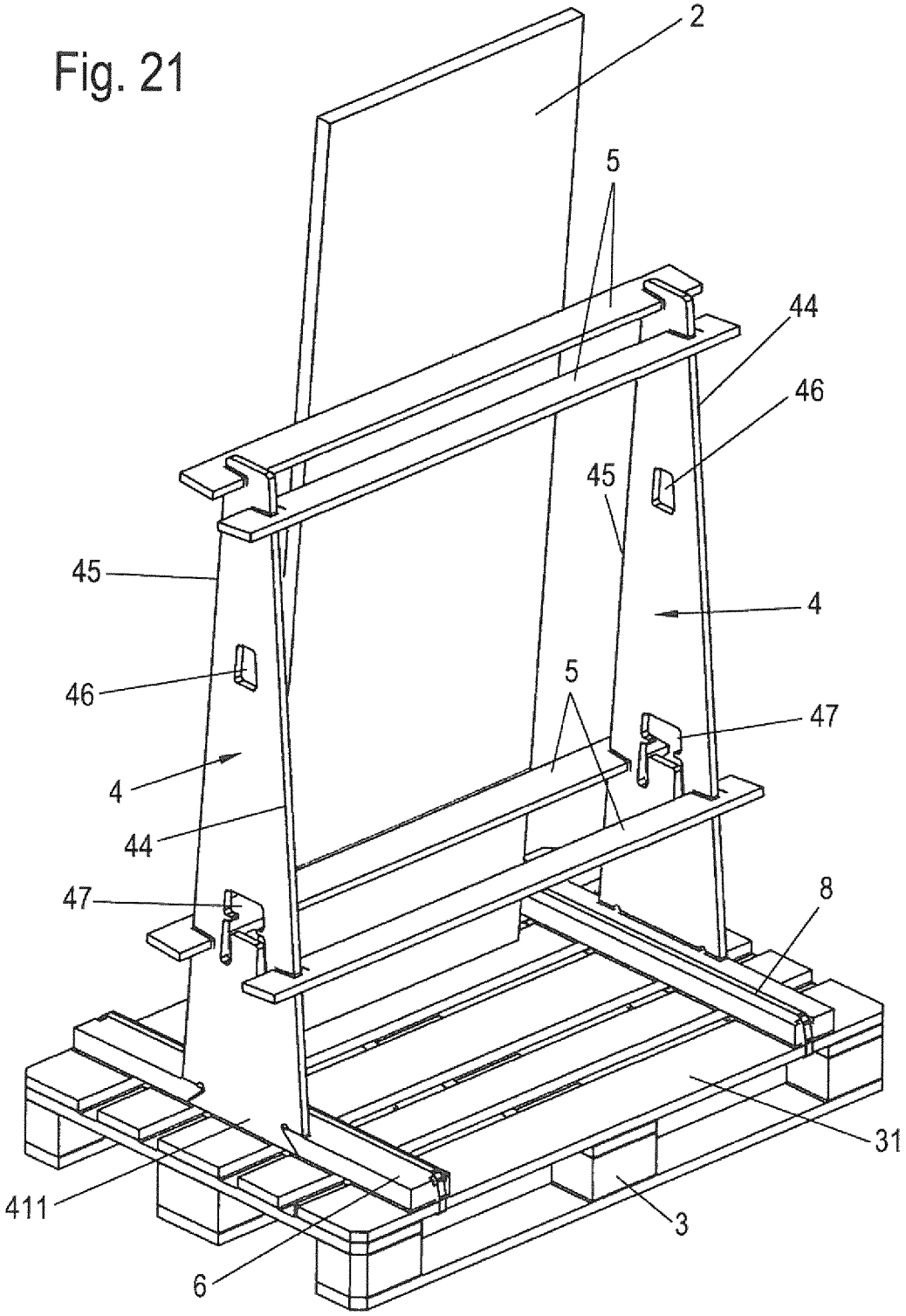
Figure 22:
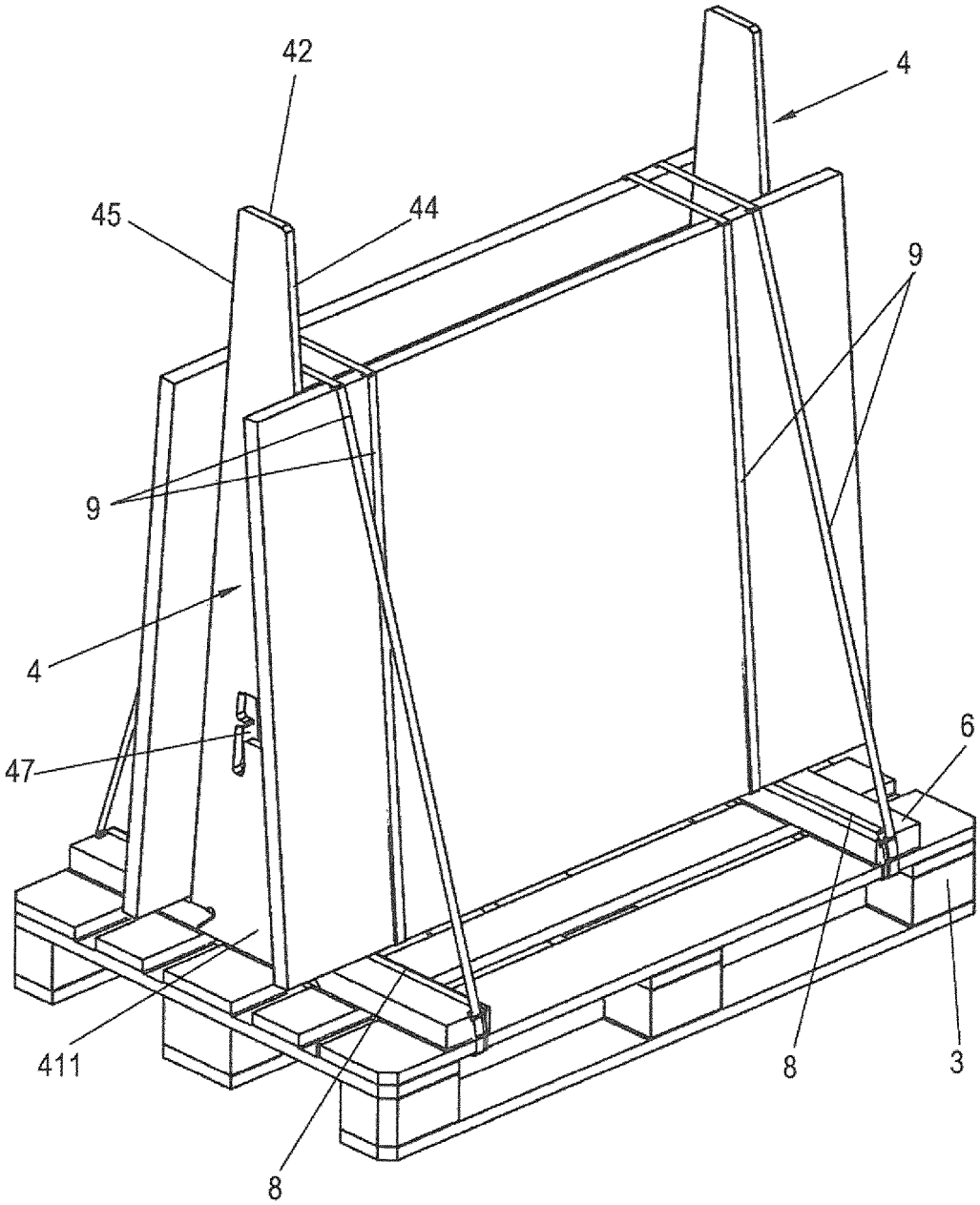
Figure 23:
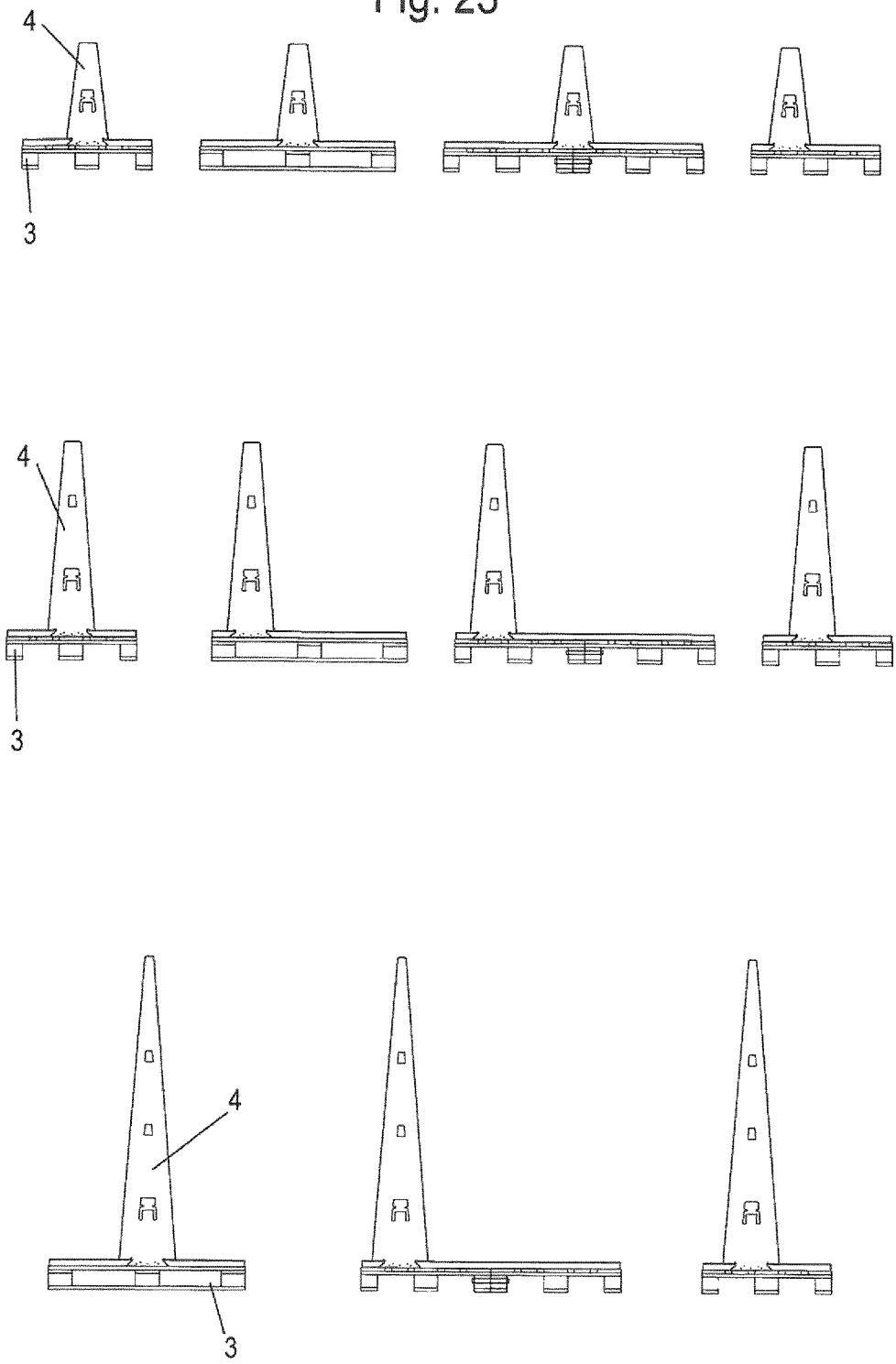

FIGS. 5*a* to *c* show side views of different embodiments of a transport rack and/or storage rack with support elements of different height;

FIGS. 6*a* to *c* show side views further embodiments of a transport rack and/or storage rack with support elements of different height for leaning on plate-shaped goods on only one side of the support elements;

FIG. 7 shows a perspective view of a transport rack and/or storage rack in the state loaded with plate-shape goods;

FIGS. 8*a* to *d* show side views of a transport rack and/or storage rack for illustrating the mounting structure;

FIG. 9 shows a perspective view of a plurality of individual support elements in the storage state which are stacked on a pallet;

FIG. 10 shows a side view of a further alternative embodiment of a support element with a trapezoidal recess for accommodating a fastening strap for fixing the plate-shaped goods;

FIGS. 11*a* to *d* show side views of further embodiments of transport racks and/or storage racks with a different number of support elements at different distances from each other;

FIG. 12 shows a perspective view of a further embodiment of a transport rack and/or storage rack in accordance with the invention in the assembled state;

FIG. 13 shows an embodiment corresponding to FIG. 12 of a transport rack and/or storage rack in accordance with the invention with four support elements;

FIG. 14 shows a perspective view of a further preferred embodiment of a transport rack and/or storage rack in accordance with the invention with a fixing element which is attached in addition as compared to the embodiment as shown in FIG. 12;

FIG. 15 shows a perspective view of the transport rack and/or storage rack shown in FIG. 12 with plate-shaped goods fixed thereto;

FIG. 16 shows a perspective enlarged sectional view of the transport rack and/or storage rack shown in FIG. 12 with an illustration of the projection of the support elements which is formed in the manner of a trapeze;

FIGS. 17 and 18 show a perspective enlarged sectional view of the transport rack and/or storage rack shown in FIG. 12 with an illustration of the recess provided on the support elements, through which the fastening straps can be guided for fixing the plate-shaped goods;

FIG. 19 shows a perspective detailed view of an alternative embodiment of recesses for accommodating the fastening straps FIGS. 20*a* to *f* show a perspective view of different embodiments of crossbars with a different number of slots;

FIG. 21 shows a perspective view of a further preferred embodiment of a transport rack and/or storage rack in accordance with the invention with crossbars mounted on the leaning edges, as compared to the embodiment shown in FIG. 12;

FIG. 22 shows a perspective view of a further preferred embodiment of a transport rack and/or storage rack in accordance with the invention without the mounted crossbar which connects the support elements to each other, and FIG. 23 shows a side view of a plurality of different configurations of transport racks and/or storage racks in accordance with the invention with support elements provided at different heights and with different positions and arranged on base plates of different sizes.

DETAILED DESCRIPTION

In the following description of the drawings, terms such as top, bottom, left, right, front, rear, etc. exclusively relate to the respective illustration and position of the transport rack and/or storage rack, the support elements, crossbar, standing strip and the like, which illustration and position are selected as examples in the illustrations. These terms are not to be understood as restrictive, i.e., these references may change in different operating positions or due to mirror-symmetric design or the like.

Figure 1:
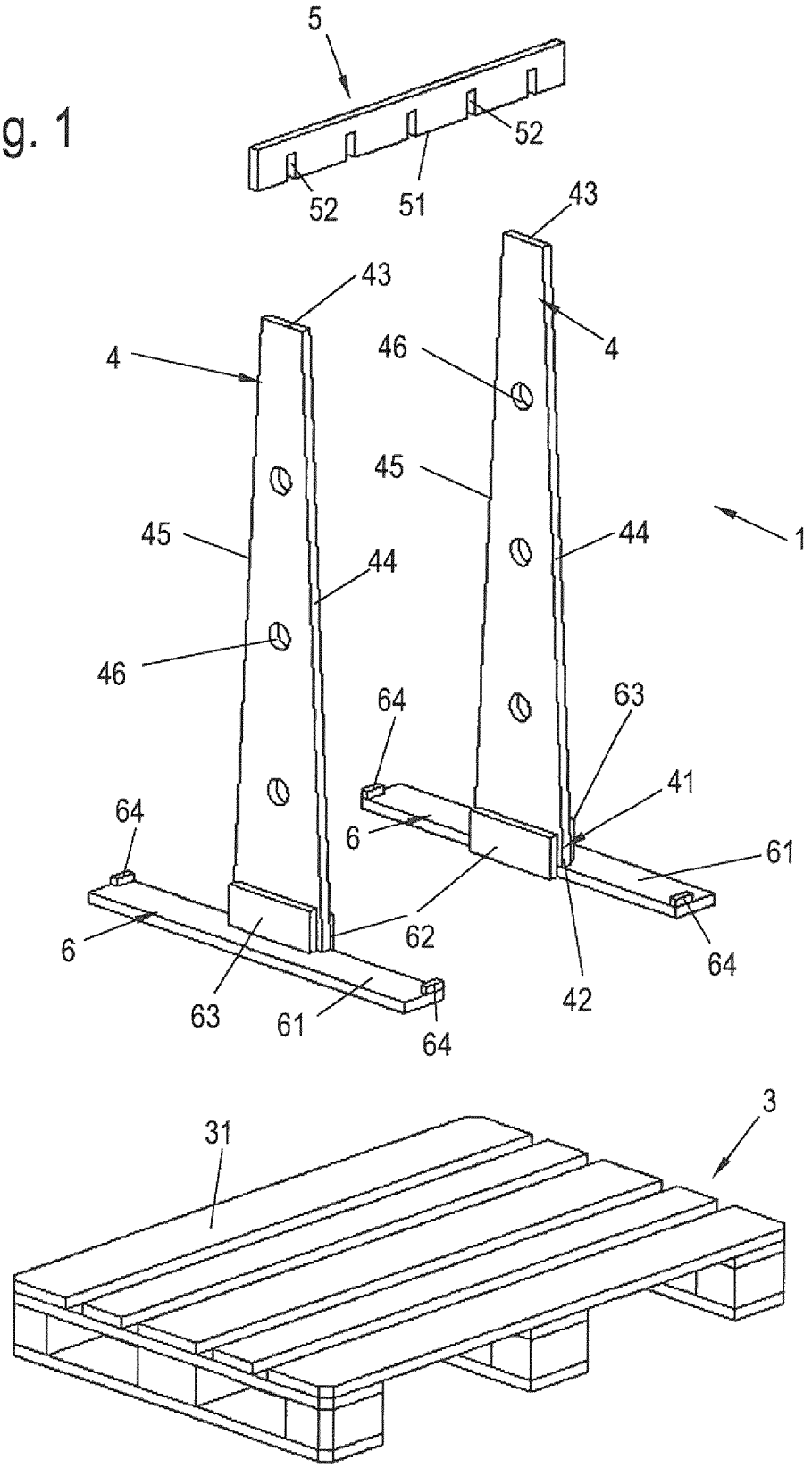
FIG. 1 shows a perspective partial exploded view of an embodiment of a transport rack and/or storage rack.

FIG. 1 shows altogether a first embodiment of a transport rack and/or storage rack in accordance with the invention with the reference numeral 1.

The transport rack and/or storage rack 1 for the standing or upright transport and/or for standing storage of plate-shaped goods 2, such as windows, doors, metal plates or wood panels, comprises at least two support elements 4, between which at least one crossbar 5 is arranged that connects the two support elements 4 to each other.

A standing strip 6, which is oriented perpendicularly to the crossbar, is arranged at a first end 41 of each of the support elements 4, which standing strip 6 can be detachably fixed to a base plate 3 by resting thereon, said base plate 3 preferably being provided in form of a pallet, especially a single-use pallet.

The use of other configurations of base plates can also be considered, e.g. transport pallets capable for multiple use such as Euro pallets.

The support elements 4 are formed as integral or multipart plates, wherein the leaning edges 44, 45, which are provided for leaning the plate-shaped goods 2 on the support elements 4, approach each other at an acute angle away from a base side 42 of the support elements 4, said base side being arranged on the standing strip 6.

The support elements 4 can be formed as plates made from one-piece or as plate parts composed of two or more thereof which are glued together or mechanically connected to each other for example.

The support elements 4 as shown in the drawings are preferably formed in a trapezoidal manner, wherein the base side 42 arranged on the standing strip 6 and an upper edge 43 opposite thereof form the base sides of the trapeze. The upper edge 43 can be formed so that it does not extend in parallel to the base side 42 but at an angle thereto, and to thus cut it into said shape.

The crossbar 5 can preferably be mounted on said upper edge 43 of the support elements 4.

As is shown in FIGS. 1 to 4, the crossbar 5 comprises several slots 52 arranged on a longitudinal side 51 and in which the upper edges 43 of the support elements 4 are accommodated in the assembled state.

Depending on the dimensions of the plate-shaped goods 2 which are to be stored or transported, as shown for example in FIGS. 1 to 4 and 11*a* to 11*d*, two, three or four support elements 4 are fastened to a base plate 3 in parallel respect to each other, which are stabilized by one, two or also three crossbars 5 in the region of the upper edge 43 of the support elements 4, through which the transport rack and/or storage rack 1 can generally be mounted in a highly flexible manner on the basis of the respective requirements and dimensions of the plate-shaped goods 2 to be transported or stored.

The slots 52 in the longitudinal side 51 of each of the crossbars 5 determine the possible distances between two each of the support elements 4.

Figure 2:
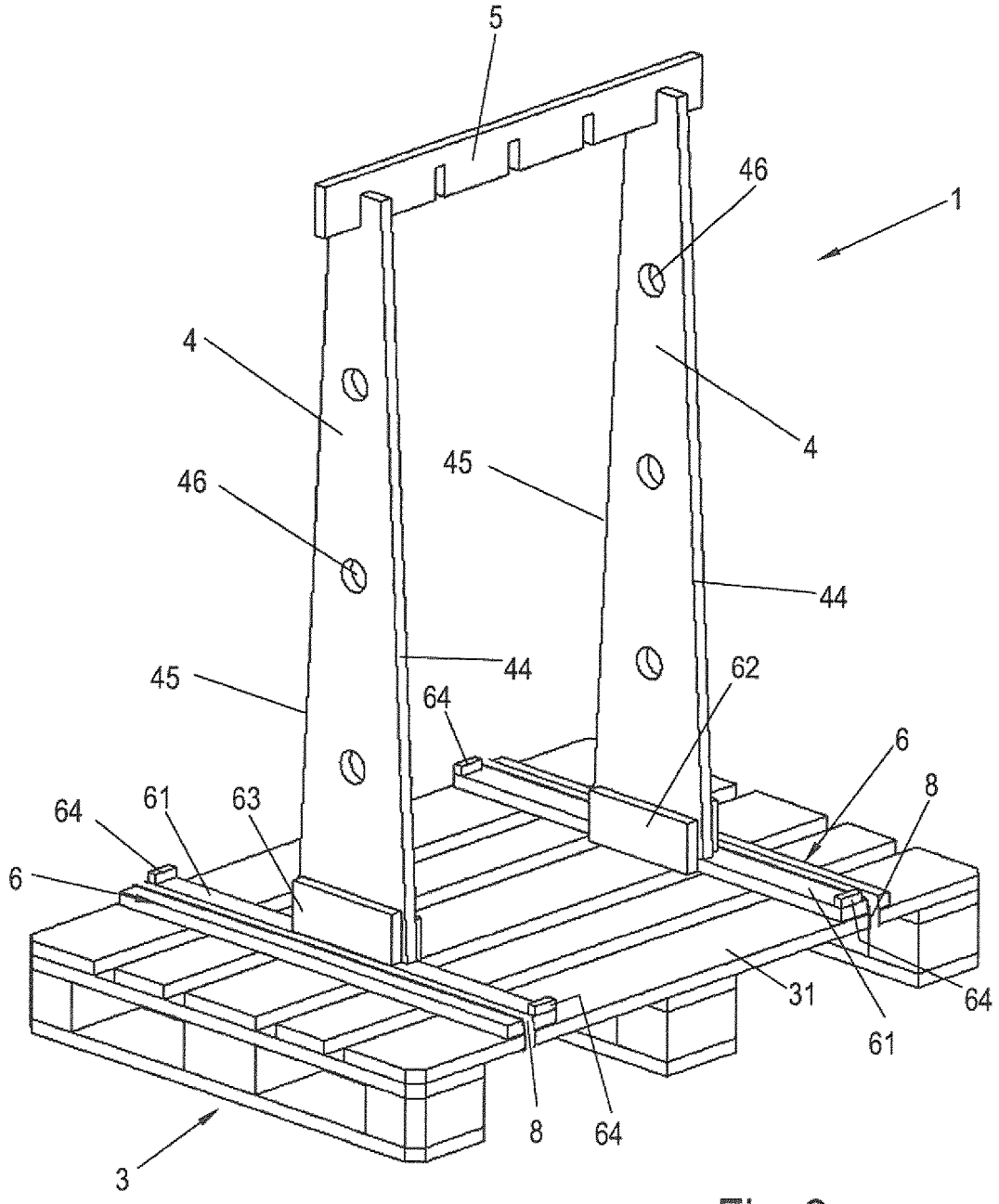
FIG. 2 shows a perspective view of the transport rack and/or storage rack of FIG. 1 in the assembled state.
Figure 3:
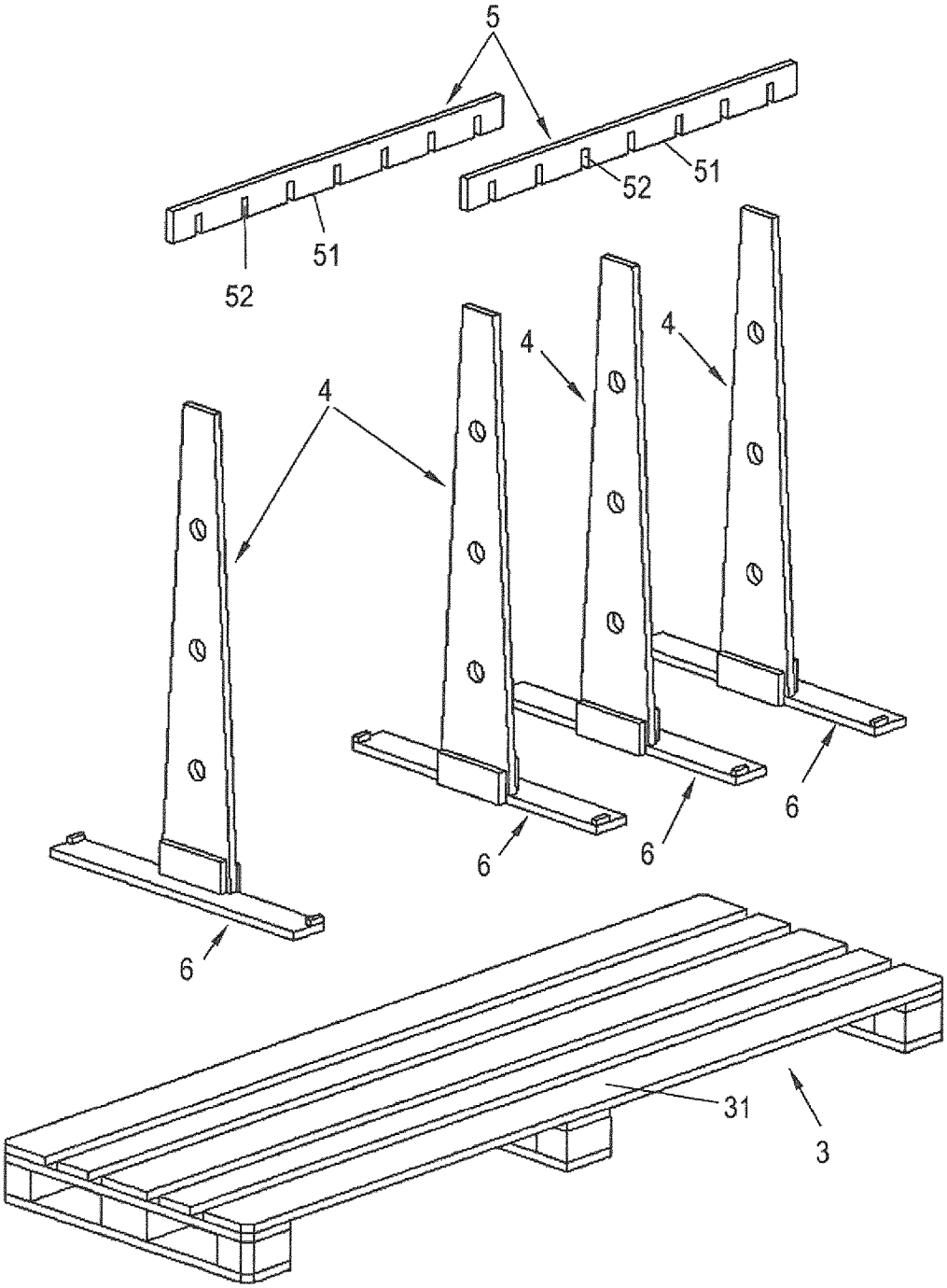
FIG. 3 shows a perspective partial exploded view of an alternative embodiment of a transport rack and/or storage rack with four support elements.
Figure 4:
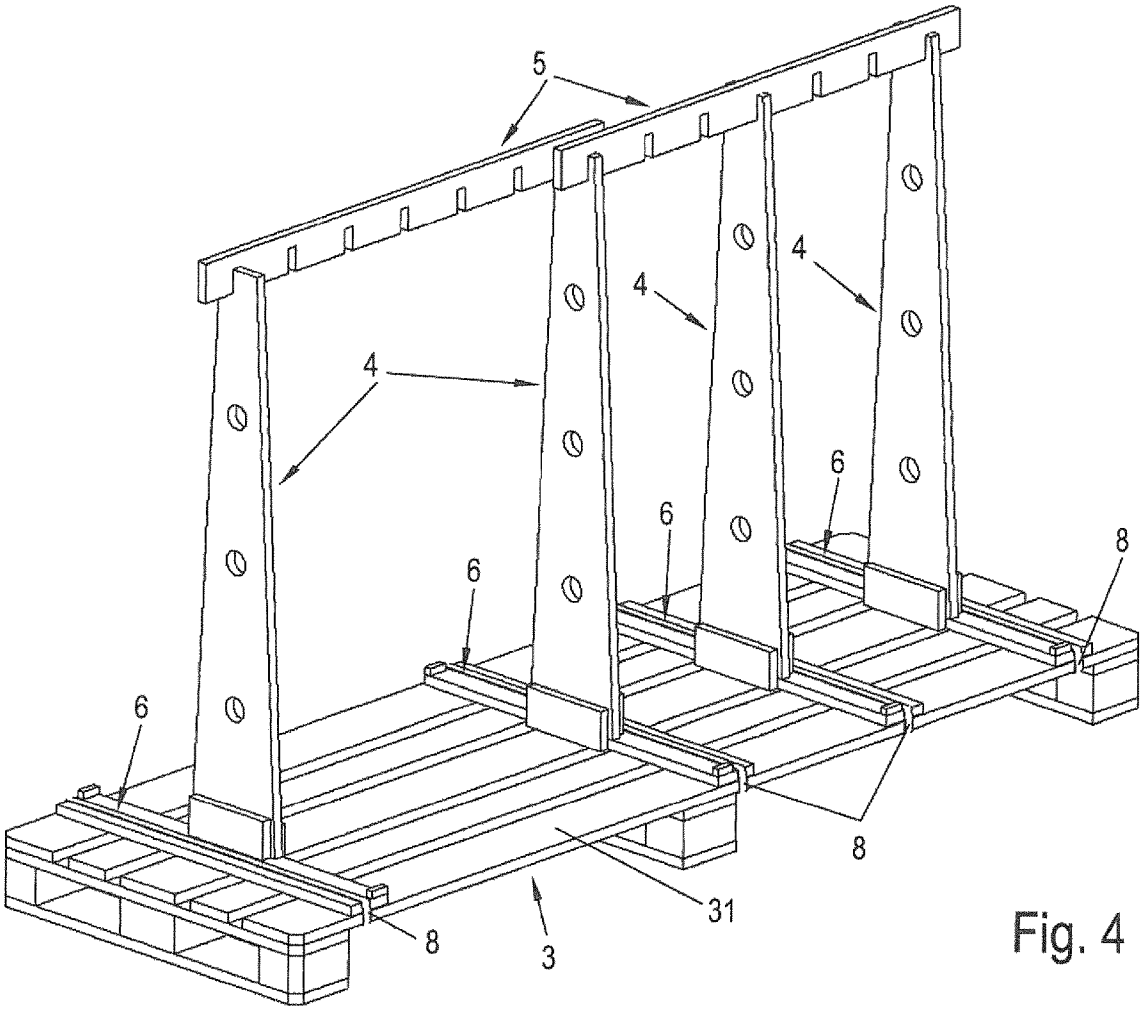
FIG. 4 shows a perspective view of the transport rack and/or storage rack of FIG. 3 in the assembled state.

The fastening of the support elements 4 to a base plate 3, which is preferably formed as a pallet, preferably occurs by tensioning straps 8, as shown in FIG. 2.

The tensioning straps 8 are preferably formed as a tensioning belt, steel belt or plastic band. The tensioning straps 8 are placed around the standing strips 6 and the support boards 3 for fastening the support elements 4, so that after the tightening of the tensioning straps 8 the standing strips 6 are fastened in a friction-locked manner to the base plate 3 in the state of the transport rack and/or storage rack 1 when fixed to the base plate 3.

As is shown in FIG. 2, the tensioning straps 8 preferably rest on an upper side 61 of the standing strips 6 along the longitudinal extension of the standing strips 6.

The fixing of the standing strip 6 with the support elements 4 preferably occurs via plates 62, 63, which extend along the base side 42 of the support elements 4 and between which the first end 41 of the support elements 4 is accommodated.

In an especially preferred embodiment, which is shown in FIGS. 8*a* to 8*d*, the first end 41 of each of the support elements 4 is connected via a bending or pivoting element 7 to the standing strip 6.

Figure 8B:
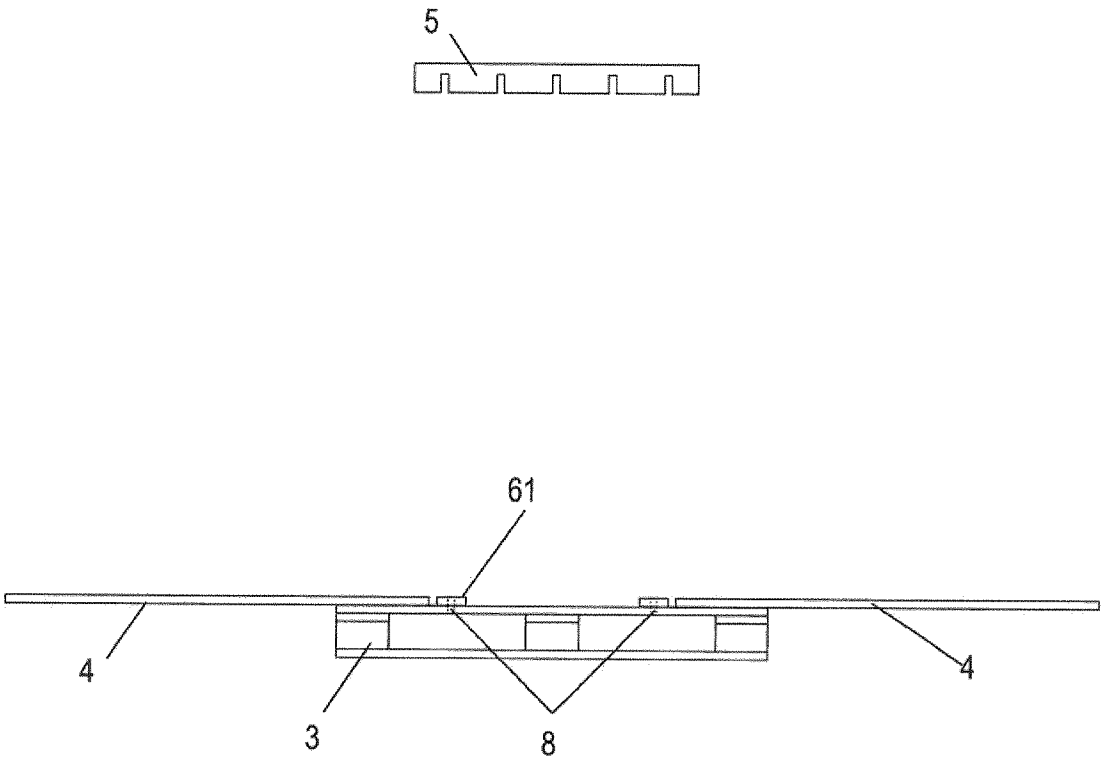
Figure 8A:
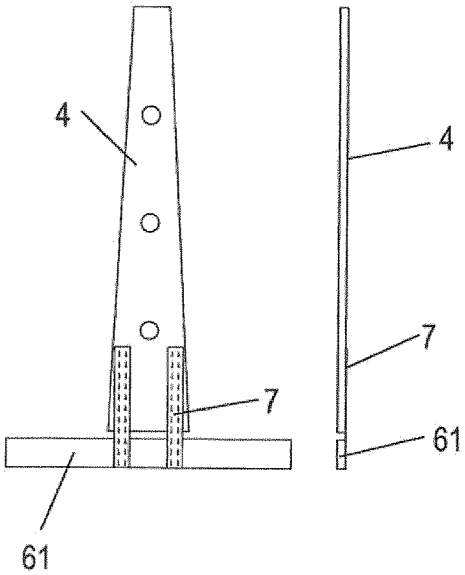
Figure 8D:
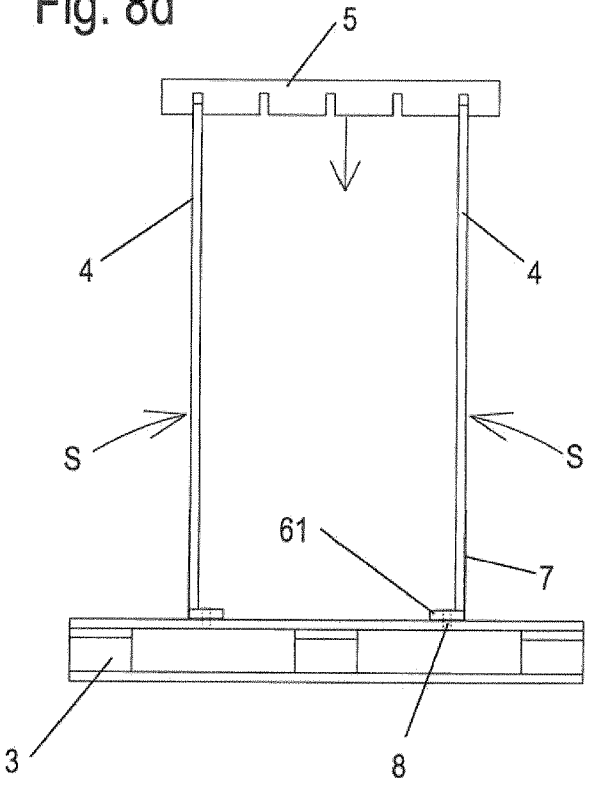
Figure 8C:
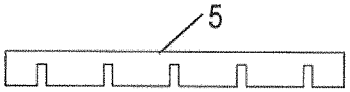
Figure 8C:
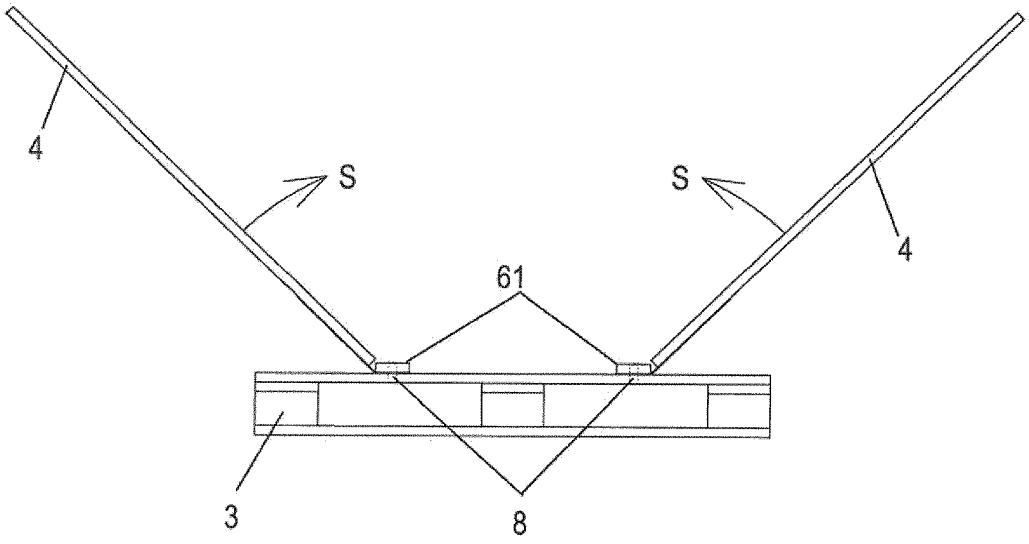

Said bending or pivoting element 7 can be formed as a hinge for example, with which the support element 4 can be pivoted from a plane parallel to the support surface of the standing strip 6 (shown in FIG. 8*b*) to a position placed perpendicularly to the support surface of the standing strip 6 (shown in FIG. 8*d*; FIG. 8*c* illustrates the pivoting process of the support elements 4 in the pivoting direction S).

In an alternative embodiment, the bending or pivoting element 7 is formed as a flexible sheet metal, especially a flexible nail plate, with which the support element 4 can be pivoted from a plane parallel to the support surface of the standing strip 6 to a position placed perpendicularly to the support surface of the standing strip 6 by bending the sheet metal, and is fixed by means of the nails of the nail plate to the support element and the standing strip.

After the erection of the support elements 4 to the position placed perpendicularly to the support surface of the standing strip 6, the crossbars 5 are mounted on the upper edge 43 of the support elements 4 for stabilizing the support elements 4.

In order to also allow the fixing of the plate-shaped goods that are placed on the transport rack and/or storage rack 1 after its assembly in a simple manner, each of the support elements 4 comprises at least one recess 46 through which the fastening straps 9 can be guided for fixing the plate-shaped goods 2. A transport rack and/or storage rack 1 loaded with plate-shaped goods 2 is shown in FIG. 7.

The plate-shaped goods 2 stand on both sides of the support elements 4, leaning on the leaning edges 44, 45 on the base plate 3, which in this case is a Euro pallet. The corners and/or at least parts of the side edges of the plate-shaped goods are protected by mountable protection elements 10, 11. A stack of plate-shaped goods 2 leaning on one side of the support elements 4 is surrounded by a fastening strap 9.

In order to prevent the plate-shaped goods 2 from slipping away from an outer edge of the support surface of the standing strips 6, stops 64 are preferably arranged at the ends of the support surfaces of the standing strips 6 which are spaced from each other in the longitudinal extension.

The supporting elements 4, the at least one crossbar 5 and the standing strips 6 are preferably made from wood, metal or dimensionally stable plastic.

By forming the support elements 4 as integral or multipart plates made from a material that is easy to process, they can also be produced in a simple way in different heights, as shown in FIGS. 5*a* to 5*c*.

The transport rack and/or storage rack 1 can also be formed in such a way that the support elements 4 are arranged on the base plate at the edge side, wherein the support elements 4 are formed with only one leaning edge which projects back upwardly at an acute angle in relation to the longitudinal extension of the support elements 4, so that the plate-shaped goods 2 are only leaned onto one side of the support elements 4.

As illustrated in FIGS. 6*a* to 6*c*, the second leaning edge 45 which is not used in this case as a leaning edge is oriented perpendicularly to the base side 42, arranged on the standing strip 6, which leaning edge 45 is preferably vertical when used.

FIGS. 12 to 20 show further embodiments of the transport rack and/or storage rack in accordance with the invention.

FIG. 12 shows a transport rack and/or storage rack 1 with two support elements 4 arranged at a distance from each other, whereas FIG. 13 shows a transport rack and/or storage rack 1 with four support elements 4 arranged at a distance from each other.

FIG. 23 shows a side view of several variants of transport racks and/or storage racks 1 with different sized support elements 4 and with support elements 4 arranged at different positions on base plates of different sizes.

In the embodiment shown in FIGS. 12 to 15 and in contrast to the embodiment shown in FIG. 1, the first end 41 of the support elements 4 is provided with a projection 411 which is formed in the manner of a trapeze and which, extending away from a base side 412 of the respective support element 4 resting on the standing strip 6, is accommodated in a recess of the standing strip 6 provided with respectively formed oblique supporting surfaces.

The trapezoidal projection 411, which is shown in FIG. 16 in detail and whose base side 412 is broader in the longitudinal extension of the standing strip 6 than the region of the projection 411 directly before the transition into the main body of the support element 4, comprises oblique side surfaces 413, which converge via a rounded portion 414 into the base side 412 of the support element 4 resting on the standing strip 6.

The rounded portion 414 prevents a breakout of a thin-walled end region of the oblique edge of the standing strip 6. This trapezoidal mortise allows further improved retaining of the support element 4 on the standing strip 6.

For the purpose of accommodating a tensioning strap 8, the standing strip 6 comprises respective guide recesses 65 in the region of its front edges, in which the tensioning strap rests in a manner secured against lateral slippage. The tensioning strap 8 engages around the standing strip 6 in the longitudinal direction of the standing strip 6 and rests on an upper side 61 of the standing strip 6, on which the base side 412 of the support element 4 also rests.

In the embodiment shown in FIG. 14, an additional fixing element 63, which is formed as square timber for example, is directly fastened to the standing strip along the base side 42 of the support elements 4, which fixing element is used for additional stabilization of the support element 4.

As is further shown in FIGS. 12 to 15 and in a detailed view in FIG. 17, each of the support elements 4 comprises a recess 47 with two grooves 472 extending away from the central opening 473, this being in addition to the aforementioned recess 46, through which the fastening straps 9 can be guided for fixing the plate-shaped goods 2, or also alternatively to said recess, e.g. in the case of support elements 4 as shown in FIG. 23 in the uppermost row which have an only very low overall height.

The inner boundary of said grooves 472 is limited by a tongue 471 extending in the longitudinal direction of the support element 4 from an edge of the recess 47 to the opening 473.

The tongue 471 is used as an abutment for a loop of a fastening strap 12, with which the plate-shaped good 2 can be fixed to the support element 4 and the base plate 3.

The loop of the fastening strap 12 can be guided through the grooves 472, thereby engaging behind the tongue 471. This enables a tensioning of plate-shaped goods 2 in the manner as shown in FIG. 15 for example.

A tensioning strap 12 is thus respectively provided in a front support element 4 and a rear support element 4, which tensioning strap, coming from a side edge of the plate-shaped good 2, is guided through the grooves 472 and thereby engages behind the tongue 471, as shown in FIGS. 17 and 18. The tensioning strap 12 extends from the recess 47 in a downwardly oblique manner to the base plate 3 and is guided through the respective window openings in the base plate 3 preferably formed as a pallet and thus tensions the base plate 3 with the support element 4 and the plate-shaped good 2 against slippage of the plate-shaped good 2 transversely to the longitudinal extension of the support elements 4.

The plate-shaped good 2 is thus secured against slippage relative to the transport rack and/or storage rack 1 by attaching such fastening straps 12 on a front and a rear support element 4.

A recess 47 formed in this manner provides slippage protection of plate-shaped goods 2, which are either arranged on one side of the support elements 4 or also in a clamping fashion between the support elements 4, as shown in FIG. 15.

As shown in FIGS. 15 to 17, a further fastening strap 9 is preferably guided through the opening 473 of the recess 47. The fastening strap 9 extends over the entire width of the plate-shaped good 2 and is guided through the openings 473 of the support elements 4 arranged one behind the other, as a result of which the plate-shaped good 2 is rigidly fixed to the respective leaning edge 44, 45 of the support elements 4.

In order to prevent slippage of the fastening strap 9 guided through the opening 473, a respective lug 474 extends into the opening 473 from at least one side edge 475 of the opening 473, preferably from both side edges 475 of the opening 473, with which slippage of the respective fastening strap 9 is effectively prevented in the tensioned state in the direction of the grooves 472.

In order to prevent slippage of the fastening strap 12 in the upward direction which is guided through the grooves 472, as shown in the configuration as illustrated in FIGS. 15 to 17, the tongue 471 is formed in such a way that it tapers slightly up to the upper root, i.e. the width $B_{Z1}$ of the tongue 471 close to the free end of the tongue 471 is greater than the width $B_{Z2}$ of the tongue 471 close to the root of the tongue. The tapering angle α shown in FIG. 17, about which the side walls 476 of the tongue 471 are inclined relative to the vertical, is preferably selected relatively low, especially less than 20°.

FIG. 19 shows a further embodiment of a support element 4, in which the recess 47, through which the fastening straps 12 can be guided for fixing the plate-shaped goods 2, are formed as separate elongated slots. The orientation of the elongated slots 48 is preferably parallel to that of the edges 44, 45. It can also be considered to orient the recesses 48 formed as elongated slots in parallel with respect to each other.

As is shown in FIGS. 13 to 15 and 20*a* to *f*, the crossbar 5 comprises a further slot 53 formed as an expansion slot adjacent to each of the slots 52, this being in addition to the slots 52 for accommodating the respective edges of the support elements 4.

The slots 52, 53 are respectively arranged in pairs adjacent to each other. The width $b_1$ of the first slot 52 of a pair of slots provided for accommodating the edges of the support elements 4 is greater than the width $b_2$ of the second slot 53.

The production tolerances in the thickness of the support elements 4 can be compensated by these additional expansion slots 53, whilst maintaining constant widths $b_1$ of the first slots 52.

It is thus additionally possible to form the first slots 52, which are used for accommodating an edge 43 or a leaning edge 44, 45 of the support elements 4, in a very precise custom-fit manner relative to the intended thickness of the support elements 4, so that when a crossbar 5 is mounted in the region of the leaning edges 44, 45 of the support elements 4, as shown in FIG. 21, the crossbar 5 is tightly clamped in such a way that as a result of friction it does not slip from the support elements 4.

As is shown in FIG. 22, the aforementioned support elements 4 with the recesses 47 are principally also suitable for a transport rack and/or storage rack 1 without a crossbar 5.

The same also applies to support elements 4 with a projection formed in the manner of a trapeze, which are also suitable for a transport rack and/or storage rack 1 in which the support elements 4 are not supported via crossbars 5, but were the transverse support occurs via the attached plate-shaped goods 2 themselves.

Although the present invention has been described above by means of embodiments with reference to the enclosed drawings, it is understood that various changes and developments can be implemented without leaving the scope of the present invention, as it is defined in the enclosed claims.

LIST OF REFERENCE NUMERALS

1 Transport rack and/or storage rack
2 Plate-shaped goods
3 Base plate
4 Support elements
5 Crossbar
6 Standing strip
7 Pivoting element
8 Tensioning strap
9 Fastening strap
10 Protection element
11 Protection element
12 Tensioning strap
41 First end
42 Base side
43 Upper edge
44 Leaning edge
45 Leaning edge
46 Recess
47 Strap leadthrough
48 Strap leadthrough
51 Longitudinal side
52 Slots
53 Expansion slot
61 Upper side
62 Plate
63 Plate
64 Stop
65 Guide recess
411 Trapeze
412 Base side
413 Oblique edge
414 Recess
415 Base side
471 Tongue
472 Slot
473 Opening
474 Lug
475 Inner side wall
476 Side wall of tongue
α Tapering angle
$b_1$ Slot width
$b_2$ Slot width
$b_{Z1}$ Width of the free end of the tongue
$b_{Z2}$ Width of the tongue in the root region of the tongue

The invention claimed is:

1. A transport storage rack for transporting and storing plate-shaped goods, including windows, doors, glass panes or stone slabs, the transport storage rack comprising:

a base plate;

at least two support elements each having a top end and an opposite bottom end, wherein the at least two support elements are each a trapezoidal panel with two angled edges;

a standing strip arranged at the bottom end of each of the at least two support elements, wherein each of the standing strips rest upon and is removably fastenable to the base plate;

at least one crossbar mounted directly on a top surface of the top end of each support element or a corresponding angled edge from said two angled edges of each support element to extend across and connect the at least two support elements to each other, wherein each of the standing strips is oriented perpendicularly to the at least one crossbar, wherein the at least one crossbar comprises several slots arranged on a bottom edge of the at least one crossbar, wherein the slots are configured to receive said top surfaces or the corresponding angled edges of the at least two support elements; and wherein the bottom end of each support element has a first width and the top end of each support element has a second width, wherein the first width is greater than the second width, and the angled edges of each support element taper towards each other from the bottom end of each support element to the top end of each support element;

wherein the bottom end of each support elements comprises a trapezoidal projection, the trapezoidal projection comprising a top end and an opposite bottom end, and two angled edges, wherein the bottom end of each trapezoidal projection has a third width and the top end of each trapezoidal projection has a fourth width, wherein the third width is greater than the fourth width, and the angled edges of each trapezoidal projection taper towards each other from the bottom end of each trapezoidal projection to the top end of each trapezoidal projection;

wherein each trapezoidal projection is received in a respectively trapezoidal shaped recess of one of the standing strips, to support each support element in an upright manner on the base plate.

2. The transport rack storage rack of claim 1, wherein the slots of the least one cross bar are respectively arranged in pairs adjacent to each other, wherein a width of a first slot of a pair of slots from said several slots is greater than a width of a second slot of said pair of slots from said several slots, wherein the first slot is a receiving slot for accommodating a corresponding top surface from said top surfaces of said at least two support elements, and the second slot is an expansion slot.

3. The transport rack storage rack of claim 1, wherein each trapezoidal projection is retained on said one of the standing strips in an interlocking manner.

4. The transport rack storage rack of claim 1, wherein the two angled edges of each support element are symmetric about a central axis of each support element.

5. The transport rack storage rack of claim 1, wherein the support elements are trapezoidal plates having an upper edge parallel to the base side of the respective support element.

6. The transport rack storage rack of claim 1, wherein each of the at least two support elements comprises at least one recess through which fastening straps can be guided for fixing the plate-shaped goods to the at least two support elements.

7. The transport rack storage rack of claim 6, wherein one of the at least one recess of the at least two support elements comprises an upper opening and a lower opening with a pair of lugs formed therebetween, wherein a tongue is formed in the lower opening and extends upwardly from a bottom surface of the lower opening, wherein two grooves are defined between the tongue and side walls of the lower opening, wherein a loop of the fastening strap, with which the plate-shaped goods is fixable to the at least two support element and the base plate, can be guided through the grooves and behind the tongue.

8. A transport storage rack for transporting and storing plate-shaped goods, including windows, doors, glass panes or stone slabs, the transport storage rack comprising:

a base plate;

at least two support elements each having a top end and an opposite bottom end, wherein the at least two support elements are each a trapezoidal panel with two angled edges;

a standing strip arranged at the bottom end of each of the at least two support elements, wherein each of the standing strips rest upon and is removably fastenable to the base plate;

at least one crossbar mounted directly on a top surface of the top end of each support element or a corresponding angled edge from said two angled edges of each support element to extend across and connect the at least two support elements to each other, wherein each of the standing strips is oriented perpendicularly to the at least one crossbar, wherein the at least one crossbar comprises several slots arranged on a bottom edge of the at least one crossbar, wherein the slots are configured to receive said top surfaces or the corresponding angled edges of the at least two support elements; and wherein the bottom end of each support element has a first width and the top end of each support element has a second width, wherein the first width is greater than the second width, and the angled edges of each support element taper towards each other from the bottom end of each support element to the top end of each support element;

wherein each of the support elements comprises at least one recess, through which a fastening strap can be guided for fixing the plate-shaped goods to the at least two support elements, wherein each recess comprises an upper opening and a lower opening with a pair of lugs formed therebetween, wherein a tongue is formed in the lower opening and extends upwardly from a bottom surface of the lower opening, wherein two grooves are defined between the tongue and side walls of the lower opening, wherein a loop of the fastening strap, with which the plate-shaped goods is fixable to the at least two support elements and the base plate, can be guided through the grooves and behind the tongue.

9. The transport rack storage rack of claim 8, wherein a first width of each tongue close to a free end of each tongue is greater than a second width of each tongue close to a proximal end of each tongue.

10. The transport rack storage rack of claim 8, wherein each of the standing strips is secured to the base plate with a tensioning strap.

* * * * *